US012788103B2

(12) United States Patent
Bidal

(10) Patent No.: US 12,788,103 B2
(45) Date of Patent: Nov. 10, 2026

(54) GOLF SHOE WITH INTERNAL LONGITUDINAL GROOVE

(71) Applicant: Acushnet Company, Fairhaven, MA (US)

(72) Inventor: Jean-Marie Bidal, Bridgewater, MA (US)

(73) Assignee: Acushnet Company, Fairhaven, MA (US)

( * ) Notice: Subject to any disclaimer, the term of this patent is extended or adjusted under 35 U.S.C. 154(b) by 59 days.

(21) Appl. No.: 17/894,354

(22) Filed: Aug. 24, 2022

(65) Prior Publication Data

US 2024/0065370 A1 Feb. 29, 2024

(51) Int. Cl.

| | |
|---|---|
| ***A43B 5/00*** | (2022.01) |
| ***A43B 13/14*** | (2006.01) |
| ***A43B 13/18*** | (2006.01) |

(52) U.S. Cl.

CPC ..... *A43B 5/001* (2013.01); *A43B 13/18* (2013.01); *A43B 13/141* (2013.01)

(58) Field of Classification Search

CPC ..... A43B 5/00; A43B 13/18; A43B 13/181

See application file for complete search history.

(56) References Cited

U.S. PATENT DOCUMENTS

| | | | | |
|---|---|---|---|---|
| 2,207,632 | A | 7/1940 | Margolin | |
| 2,327,361 | A | 8/1943 | Margolin | |
| 5,784,808 | A * | 7/1998 | Hockerson | A43B 13/181 36/102 |
| 7,207,125 | B2 | 4/2007 | Jeppesen et al. | |
| 7,461,470 | B2 | 12/2008 | Dardinski et al. | |
| 7,607,241 | B2 | 10/2009 | McDonald et al. | |
| 8,141,276 | B2 | 3/2012 | Ellis | |
| 8,640,362 | B2 | 2/2014 | Lafortune | |
| 9,510,640 | B2 | 12/2016 | Bier et al. | |
| 9,591,891 | B1 * | 3/2017 | Baucom | A43B 13/122 |
| 9,833,039 | B2 | 12/2017 | Smaldone et al. | |
| 10,251,446 | B2 | 4/2019 | Bischoff et al. | |
| 10,271,614 | B2 | 4/2019 | Huard et al. | |
| 11,213,095 | B2 | 1/2022 | Avar et al. | |
| 2009/0313856 | A1 | 12/2009 | Arizumi | |
| 2010/0299965 | A1 | 12/2010 | Avar et al. | |

(Continued)

FOREIGN PATENT DOCUMENTS

| | | |
|---|---|---|
| EP | 2358225 | 5/2014 |
| EP | 2522239 | 9/2015 |

(Continued)

*Primary Examiner* — Katharine G Kane

(57) ABSTRACT

A golf shoe with an upper and a sole assembly connected to the upper. The shoe includes an insole footbed or an insole board and a midsole, wherein at least one of the insole footbed, the insole board, or the midsole comprises one or more longitudinal grooves provided in a respective forefoot region and a rearfoot region of the insole footbed, the insole board, or the midsole to control (i) a movement of a subject's foot and (ii) a flex or a deformation of a lateral or medial section of the shoe as the subject exerts a force on the insole footbed, the insole board, or the midsole during a golf swing. The midfoot region of the insole footbed, the insole board, or the midsole has a greater torsional rigidity, stiffness, or strength than the forefoot and rearfoot regions of the insole footbed, the insole board, or the midsole.

17 Claims, 10 Drawing Sheets

(56) References Cited

U.S. PATENT DOCUMENTS

| | | | | |
|---|---|---|---|---|
| 2011/0252671 | A1* | 10/2011 | Maron | A43B 13/141 36/31 |
| 2012/0174432 | A1* | 7/2012 | Peyton | A43B 13/188 36/31 |
| 2013/0152428 | A1 | 6/2013 | Bishop et al. | |
| 2014/0013624 | A1* | 1/2014 | Stockbridge | A43B 13/181 36/103 |
| 2014/0182169 | A1* | 7/2014 | Mack | A43B 13/141 36/102 |
| 2014/0259743 | A1* | 9/2014 | Bernhard | A43B 13/127 36/28 |
| 2015/0047222 | A1* | 2/2015 | Rushbrook | A43B 13/141 36/83 |
| 2015/0089841 | A1* | 4/2015 | Smaldone | A43B 13/122 36/103 |
| 2016/0037857 | A1* | 2/2016 | Foxen | A43B 7/1405 36/103 |
| 2016/0037858 | A1* | 2/2016 | Foxen | A43B 7/144 36/103 |
| 2017/0367438 | A1* | 12/2017 | Del Biondi | A43B 13/223 |
| 2019/0082781 | A1 | 3/2019 | Iuchi et al. | |
| 2019/0150558 | A1 | 5/2019 | Shorten | |
| 2020/0022452 | A1* | 1/2020 | Hatano | A43B 13/181 |
| 2022/0346492 | A1* | 11/2022 | Jenkins | A43B 13/26 |
| 2023/0137398 | A1* | 5/2023 | Caldwell | A43B 13/127 36/28 |
| 2023/0371656 | A1* | 11/2023 | Iuchi | A43B 13/141 |

FOREIGN PATENT DOCUMENTS

| | | |
|---|---|---|
| EP | 2946681 | 4/2018 |
| EP | 3050453 | 2/2020 |
| WO | 2012021421 | 2/2012 |

* cited by examiner

DORSAL VIEW

GOLF SHOE WITH INTERNAL LONGITUDINAL GROOVE

BACKGROUND

The sport of golf can involve a variety of actions that a subject (e.g., a golfer) may perform, such as swinging a golf club, walking a golf course, crouching down to line up a putt, and other golfing actions. Having the proper equipment to play golf may affect how well a golfer can perform golf-related actions or movements.

Golf shoes are one example of a piece of equipment that can affect a golfer's performance. For example, when golfers swing a club and transfer the weight on their feet, there are numerous forces exerted on the sole assembly of the golf shoe. As such, golf shoes need to provide a stable platform for golfers to execute a swing, while also retaining some flexibility to accommodate and/or control the movement of a golfer's feet during a swing.

SUMMARY

Recognized herein are various shortcomings and disadvantages of conventional golf shoes that utilize groove structures optimized for physical activities such as running or walking, which can involve different biomechanical movements than golf-related actions (e.g., swinging a golf club). Traditional groove structures designed for running or walking may not provide the stability and flexibility required to execute an optimal golf swing, since the forces exerted on the shoe and sole structure during running or walking can be very different than those exerted on the shoe and sole structure as a subject (e.g., a golfer) shifts his or her weight or twists/pivots his or her foot during a golf swing.

The present disclosure generally relates to golf shoes having one or more internal grooves for promoting the flex characteristics (e.g., longitudinal flex characteristics) of uppers, sole assemblies, and/or any components or portions thereof (including insole footbeds, insole boards, midsoles, and/or outsoles). The golf shoes of the present disclosure may utilize a longitudinal groove construction that can allow golfers to remain posted on the first and/or second metatarsal regions of their trail foot for a longer period, thereby delaying the natural roll of the trail foot and increasing the contact time between the trail foot and the ground. The longitudinal groove construction may also aid in limiting or restricting the movement (e.g., pivoting or elevation) of a golfer's trail foot before the club impacts the ball and the golfer follows through with his or her swing. Restricting or limiting the movement of a golfer's foot inside a shoe before impact can reduce the number of variables affecting the golfer's swing or the impact, which can ultimately improve shot accuracy and lead to tighter balls dispersions.

Examples of the present disclosure describe a golf shoe comprising one or more internal longitudinal grooves that permit the golf shoe to deform in a desired manner during golf swing sequences to (i) limit or restrict the movement or displacement of a golfer's trail foot and (ii) increase a contact time between the golfer's trail foot and the ground during a golf swing.

In one aspect, the present disclosure provides a golf shoe comprising an insole footbed or an insole board and a sole assembly comprising a midsole. In some embodiments, at least one of the insole footbed, the insole board, or the midsole comprises one or more longitudinal grooves. The one or more longitudinal grooves are provided in a respective forefoot region and a rearfoot region of the insole footbed, the insole board, or the midsole to control (i) a movement of a subject's foot and (ii) a flex or a deformation of a lateral or medial section of the insole footbed, the insole board, or the midsole as the subject exerts a force on the insole footbed, the insole board, or the midsole during a golf swing. In some embodiments, a midfoot region of the insole footbed, the insole board, or the midsole has a greater torsional stiffness, rigidity, or strength than the forefoot and rearfoot regions of the insole footbed, the insole board, or the midsole.

In some embodiments, the one or more longitudinal grooves comprise (1) a first longitudinal groove disposed on the forefoot region of the insole footbed, the insole board, or the midsole and (2) a second longitudinal groove disposed on the rearfoot region of the insole footbed, the insole board, or the midsole. In some embodiments, the first longitudinal groove and the second longitudinal groove are separated by a predetermined distance spanning at least a portion of the midfoot region of the insole footbed, the insole board, or midsole.

In some embodiments, the one or more longitudinal grooves comprise (1) a first longitudinal groove disposed on the insole footbed or the insole board and (2) a second longitudinal groove disposed on the midsole. In some embodiments, the first longitudinal groove and the second longitudinal groove are aligned relative to each other to collectively and synergistically enhance a longitudinal flex of the insole footbed, the insole board, or the midsole.

In some embodiments, the golf shoe may further comprise an outsole comprising a third longitudinal groove. In some embodiments, at least one of the first or second longitudinal groove is aligned with the third longitudinal groove to collectively and synergistically enhance a longitudinal flex of the insole footbed, the insole board, or the midsole.

In some embodiments, the golf shoe may further comprise one or more additional grooves between a lateral side and a medial side of the insole footbed, the insole board, or the midsole. In some embodiments, the one or more additional grooves intersect the one or more longitudinal grooves. In other embodiments, the one or more additional grooves do not intersect the one or more longitudinal grooves. In some embodiments, the one or more additional grooves have a different size or shape than the one or more longitudinal grooves.

In some embodiments, the midfoot region of the insole footbed, the insole board, or the midsole has a torsional rigidity ranging from about 10 Newton-centimeters (N-cm) to about 100 N-cm. In some embodiments, the midfoot region of the insole footbed, the insole board, or the midsole has a torsional stiffness ranging from about 10 Newton-centimeters per degree (N-cm/deg) to about 100 N-cm/deg. In some embodiments, the midfoot region of the insole footbed, the insole board, or the midsole has a torsional shear modulus ranging from about 0.1 Megapascals (MPa) to about 100 MPa.

In some embodiments, the golf shoe may comprise a network of grooves. In some embodiments, the network of grooves comprises different subsets of grooves configured to control (i) the flex or deformation of the lateral or medial section of the insole footbed, the insole board, or the midsole and (ii) the movement of the subject's foot differently based on a property or characteristic of the subject's swing. In some embodiments, the property or characteristic of the subject's swing corresponds to a movement or a displacement of the subject's foot during the golf swing.

In another aspect, the present disclosure provides a golf shoe comprising an insole footbed or an insole board and a sole assembly comprising a midsole. In some embodiments, at least one of the insole footbed, the insole board, or the midsole comprises an internal longitudinal groove extending between a medial midfoot region and a lateral forefoot region of the insole footbed, the insole board, or the midsole to divide the insole footbed, the insole board, or the midsole into an upper region and a lower region. In some embodiments, the upper region and the lower region are configured to flex relative to each other to increase a contact time between the sole assembly and a ground surface under the sole assembly as a subject wearing the golf shoe executes a golf swing.

In some embodiments, the upper region has a first area and the lower region has a second area. In some embodiments, a ratio of the first area and the second area ranges from about 1:1 to about 1:10.

In some embodiments, the upper region is configured to flex independently of the lower region to control a movement of a first and/or second metatarsal structure of the subject's foot as the subject exerts a dynamic force on the insole footbed, the insole board, or the midsole during the golf swing. In some embodiments, the internal longitudinal groove is disposed at a first angle relative to a longitudinal center line of the shoe. In some embodiments, the first angle ranges from about 5 degrees to about 45 degrees. In some embodiments, the internal longitudinal groove is disposed at a second angle relative to a midline of the shoe. In some embodiments, the second angle ranges from about 90 degrees to about 135 degrees.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Non-limiting and non-exhaustive examples are described with reference to the following figures.

DETAILED DESCRIPTION

Figure 1A:
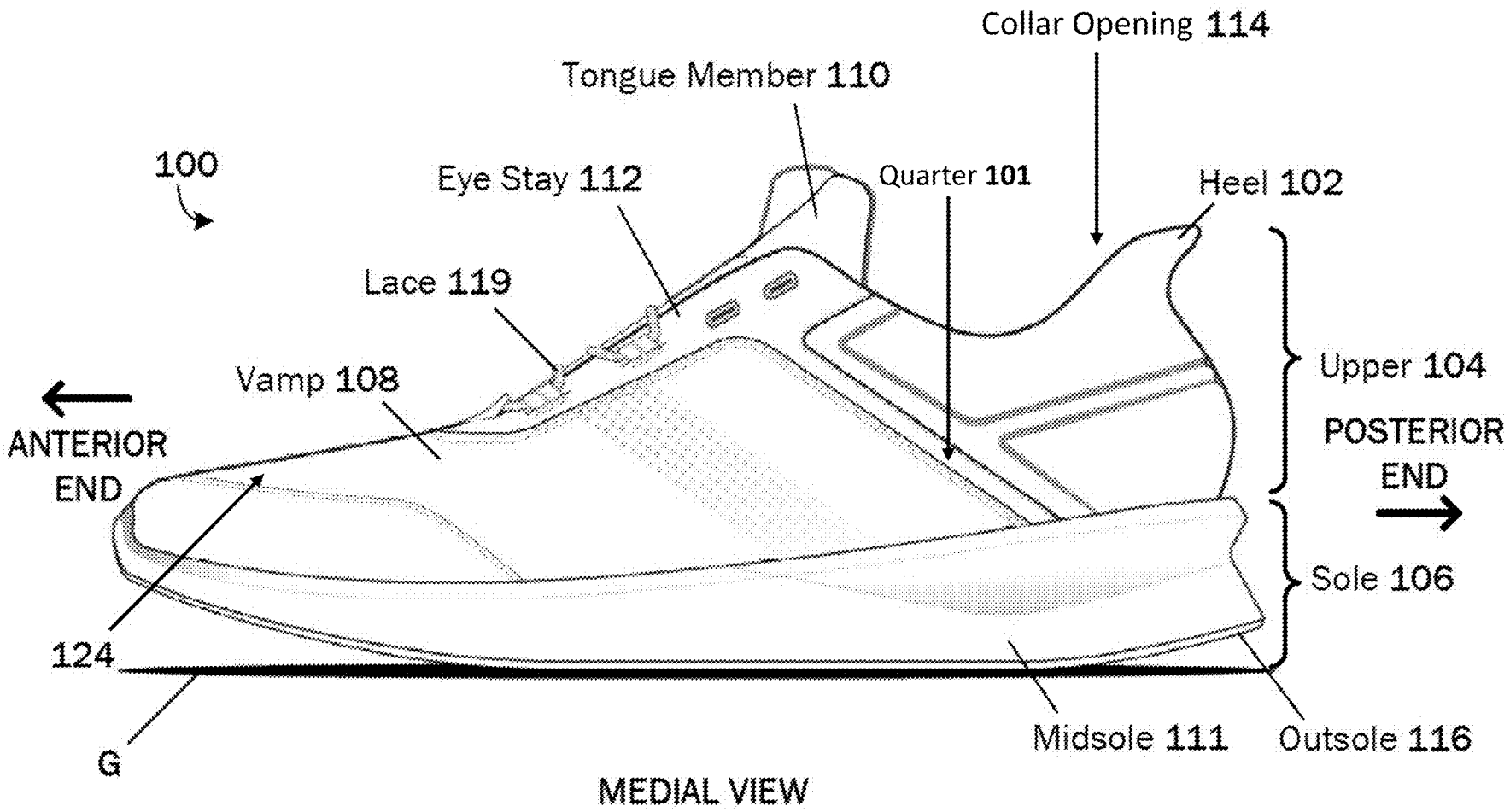
FIG. 1A depicts a medial side view of an exemplary golf shoe comprising one or more internal grooves, in accordance with some embodiments.
Figure 1B:
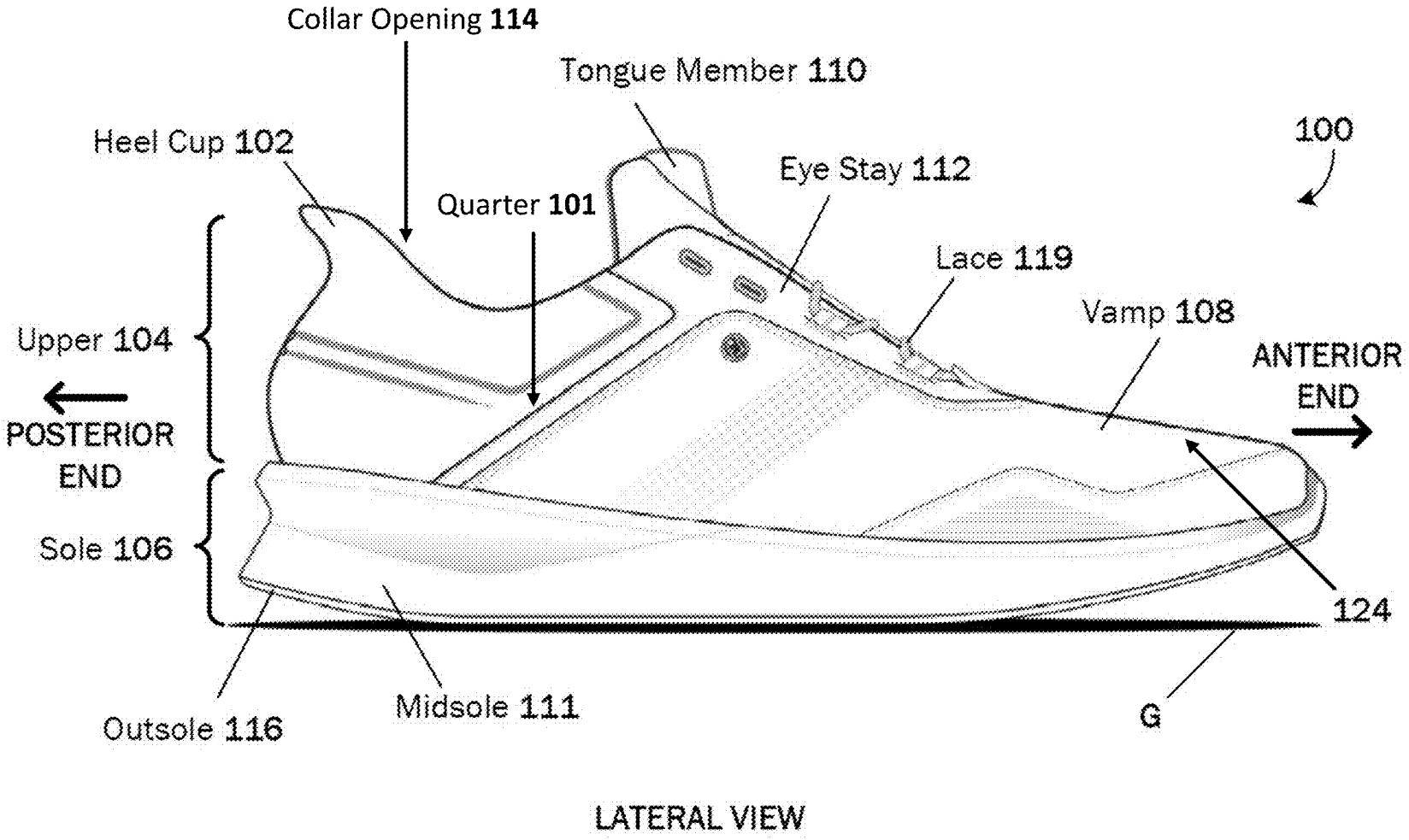
FIG. 1B depicts a lateral side view of the golf shoe of FIG. 1A.

The present disclosure will now be described more fully in reference to the accompanying figures, in which various non-limiting embodiments are shown. However, this disclosure should not be construed as limited to the embodiments set forth herein. In the drawings, like numbers refer to like elements throughout. Thicknesses and dimensions of some components may be exaggerated for clarity. The views shown in the Figures are of a right shoe and it is understood that in some cases, the components for a left shoe can be mirror images of the right shoe. It also should be understood that the shoe may be made in various sizes and thus the size of the components or features (e.g., internal grooves) of the shoe may be adjusted depending upon the shoe size.

The terminology used herein is for the purpose of describing various embodiments only and is not intended to be limiting. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," directly coupled" or "directly connected" to another element, there are no intervening elements present.

It is noted that any one or more aspects or features described with respect to one embodiment may be incorporated in a different embodiment. That is, all embodiments and/or features of any embodiment can be combined in any way and/or in any combination. Applicant reserves the right to modify any originally filed claim or file any new claim(s) accordingly, including the right to be able to amend any originally filed claim to depend from and/or incorporate any feature of any other claim although not originally claimed in that manner. The various aspects and features of the present disclosure are explained in further detail in the specification set forth below.

Depending upon the length of the course, speed of play, and other factors, a golfer may walk a few miles in a round. Thus, a golf shoe needs to provide ample support and be comfortable to wear so that a golfer can walk naturally and freely.

From a performance standpoint, a golf shoe also needs to be rigid and flexible so that the golfer can perform other golf-specific actions that involve distinct motions not typically made during physical activities such as walking or running. Such golf-specific actions may include, for example, addressing a golf ball, swinging a golf club, and/or crouching down to line up a shot. Although some athletic shoes may provide cushioning and support, one significant drawback is that they lack a stable platform that can also flex longitudinally to control foot movement when a golfer executes a golf swing.

When playing golf, there are many dynamic forces that can act on a golfer's feet and different parts or sections of a golfer's shoe. As a golfer swings a club and transfers his or her weight (e.g., from a trail foot to a lead foot or vice versa), the trail foot/lead foot and shoe may experience a number of different forces. For example, when a right-handed golfer is first planting their feet before beginning a club swinging motion (e.g., when addressing the ball), his or her weight may be evenly distributed between the lead foot and the trail foot. As the golfer begins a backswing, his or her weight may shift primarily to the trail foot. Significant pressure and torsion may be applied to the trail foot at the beginning of the downswing as the golfer drives power off of the trail foot to generate increased swing speeds. As the golfer follows through with the swing and impacts the ball, his or her weight may be transferred from the trail foot to the lead foot, with the lead shoe rolling from the medial side (inside) toward the lateral side (outside) of the front foot, and the trail shoe simultaneously flexing and internally rotating as the heel lifts. During the swinging motion, there may be some pivoting/elevation at the trail and lead feet. This pivoting/elevation motion can be controlled so that the golfer's feet do not substantially move or slip relative to the shoe or ground before or during impact.

Given the complex biomechanics behind a golf swing, it would be advantageous to control the movement of a golfer's feet (e.g., the trail foot and/or the lead foot) during a swing to minimize the number of variables that can affect swing kinematics, impact, and ball flight. The present disclosure provides various embodiments of golf shoes comprising one or more longitudinal grooves that can be positioned internally within a shoe (or a sole assembly of a shoe) to promote longitudinal flexibility while still maintaining high rigidity and torsional stability, which can lead to more accurate and precise shots. The longitudinal grooves of the present disclosure can be positioned and oriented strategically within the sole assembly to provide greater stiffness (flexural and/or torsional) in at least the midfoot area of the sole assembly. The positioning and orientation of the longitudinal grooves may also provide the shoe with additional mechanical strength, torsional stability, and structural integrity that limits excessive twisting or turning of the shoe and retains longitudinal flexibility so that a golfer is able to control the movement of his or her feet during a swing and keep a portion of his or her lead foot or trail foot in contact with the ground for a longer period of time. The position, shape, and/or orientation of the longitudinal grooves may further help to promote a natural transition to the golfer's driving foot during push off and follow through, giving the golfer a more natural swing feeling when shifting his or her weight to different portions or regions of his or her feet or shoes over the course of a swing. The golf shoes comprising the internal longitudinal grooves described herein may provide an optimal balance of torsional stiffness, rigidity and longitudinal flexibility while preserving underfoot cushioning/support and comfort characteristics.

In an aspect, the present disclosure provides a golf shoe. The golf shoe may comprise an article of footwear (e.g., a shoe) that can be worn by a subject to aid in a physical activity such as golf, or any other physical activity involving one or more actions or movements that are used in the sport of golf. In some embodiments, the golf shoe may comprise an upper. In some embodiments, the golf shoe may comprise a sole assembly. In some cases, the sole assembly may be connected to the upper.

The golf shoe may be worn by a subject. The subject may be, for example, an athlete or a golf player. When worn by the subject, the golf shoe may provide an optimal balance of comfort and control that allows the subject to focus on his or her game and maximize performance. The golf shoe may be sized, shaped, and configured to control a movement of the subject's foot during a golf swing to enhance the subject's stance, swing, stability, and/or overall performance (e.g., accuracy or precision).

Figure 1C:
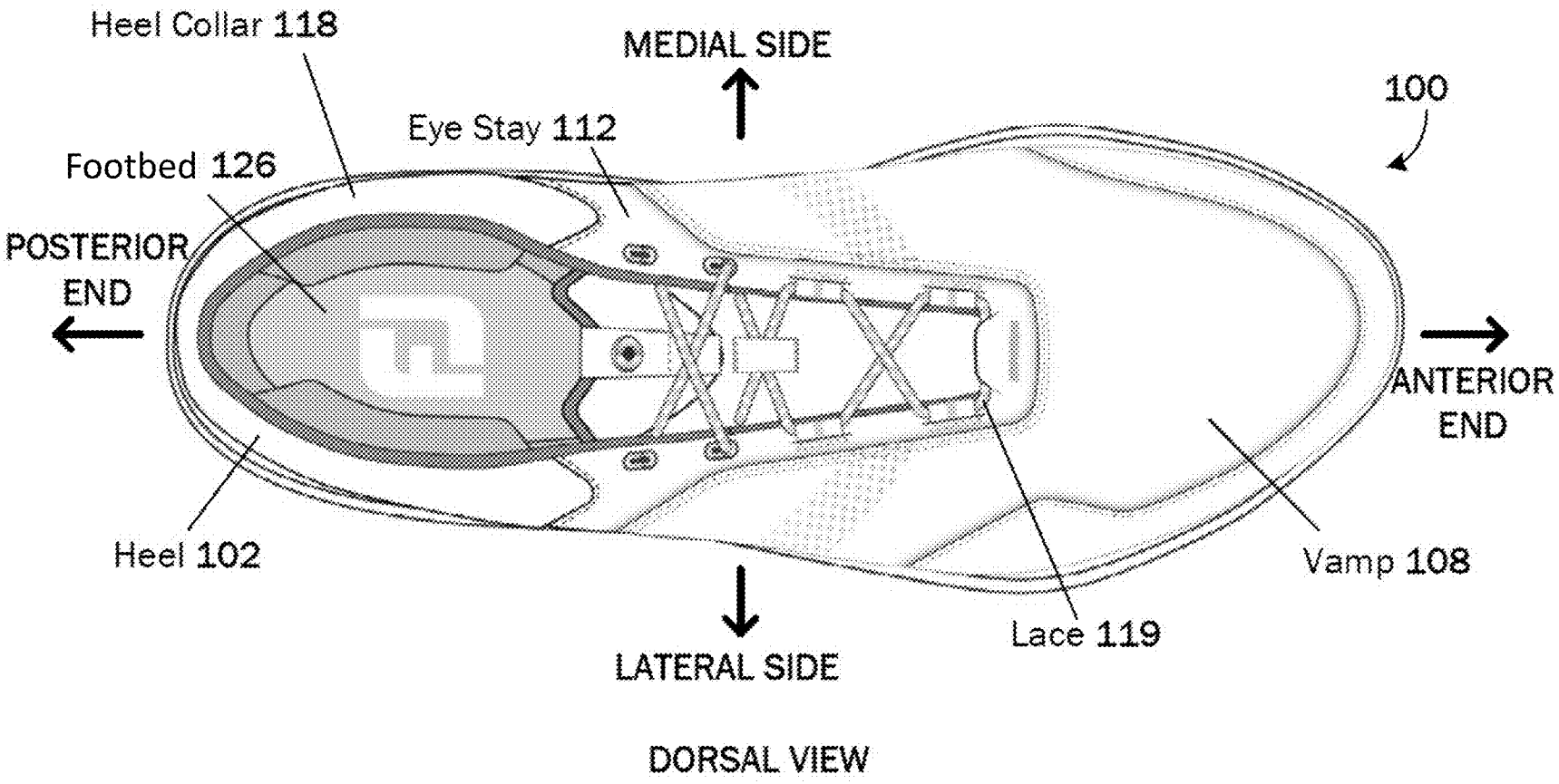
FIG. 1C depicts a dorsal (top) view of the golf shoe of FIG. 1A.
Figure 1D:
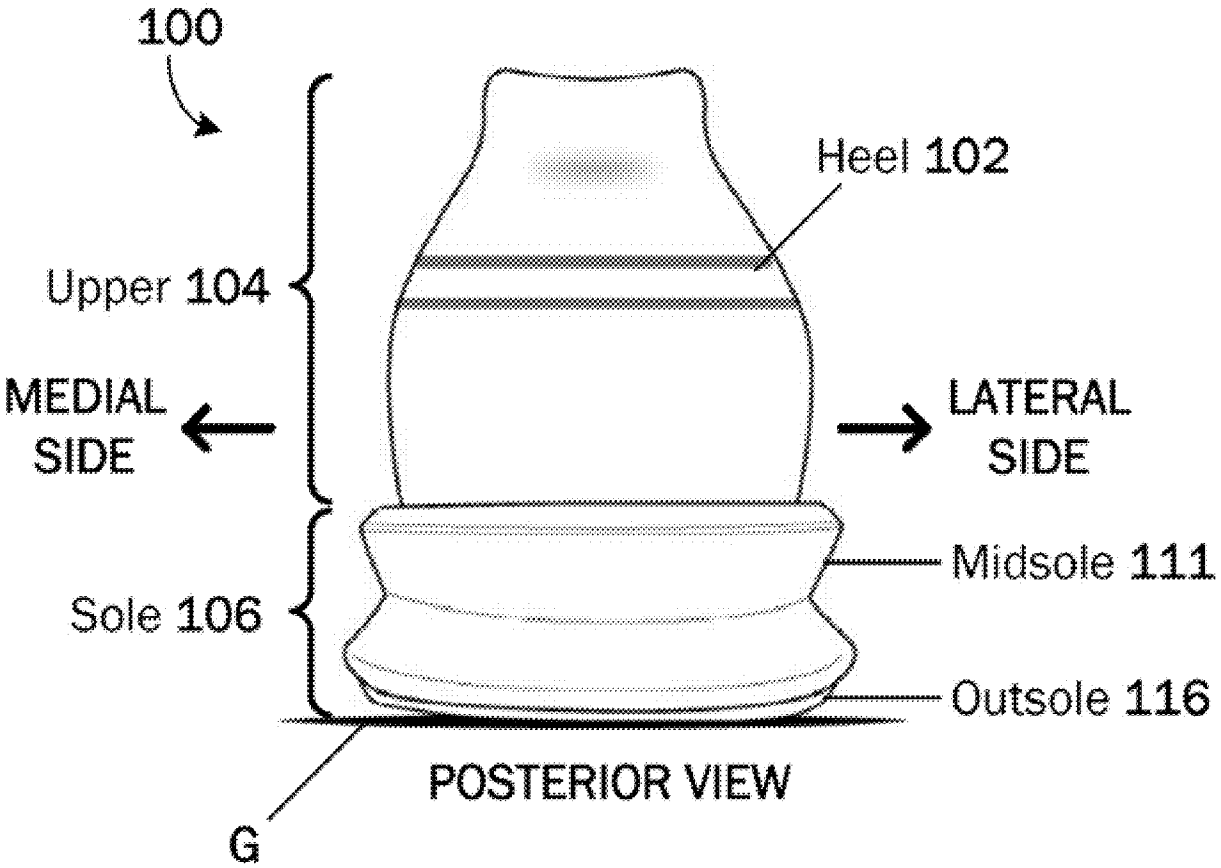
FIG. 1D depicts a posterior (rear) view of the golf shoe of FIG. 1A.

FIGS. 1A-1D depict various views of an exemplary golf shoe 100, also referred to herein generally as a shoe 100. The golf shoe 100 may comprise one or more internal longitudinal grooves as described in further detail below. FIG. 1A is a medial (e.g., inner) side view of the shoe 100, FIG. 18 is a lateral (e.g., outer) side view of the of the shoe 100, FIG. 1C is a dorsal (top) view of the shoe 100, and FIG. 1D is a posterior (rear) view of the shoe 100.

In some embodiments, the shoe 100 may comprise a shoe upper 104 and a sole assembly 106. In some cases, the sole assembly 106 may include a midsole 111 and/or an outsole 116. In some cases, the shoe upper 104 and/or the sole assembly 106 may include an insole and/or one or more insole components. The insole and/or the one or more insole components may comprise any component(s), material(s), or layer(s) of the shoe 100 that are positioned between (i) the midsole of the shoe and (ii) a subject's foot. In some non-limiting embodiments, the one or more insole components may comprise a footbed (also referred to herein as an "insole footbed") or a board (also referred to herein as an "insole board").

In some embodiments, the golf shoe 100 may comprise an upper 104. In some cases, the upper 104 may comprise a vamp 108 for covering at least a forefoot region of a subject's foot. In some cases, the upper 104 may comprise a quarter 101 for covering and/or supporting one or more side or rear portions of a subject's foot (e.g., the area adjacent to, surrounding, and/or below the Achilles tendon, the posterior of the heel, and/or the talus and calcaneus bones).

In some embodiments, the heel region of the quarter 101 may comprise a heel cup 102. In some cases, the heel cup 102 may comprise a molded heel cup. In some embodiments, at least a portion of the quarter 101 may form a part of the molded heel cup. In some embodiments, the quarter 101 may comprise a plurality of layers that may be molded together to form the heel cup 102.

In some embodiments, the vamp 108 and the quarter 101 may comprise separate pieces of material that are connected or fused to each other mechanically, chemically, thermally, or adhesively. In some cases, the upper material may be stitched or bonded together to form an upper structure.

In some embodiments, the upper 104 may comprise a continuous piece of material for the vamp 108 and quarter 101. In some cases, the continuous piece of material may comprise a single material comprising a plurality of regions each having different material properties. In other cases, the continuous piece of material may comprise a plurality of materials having different material properties. The material properties associated with the plurality of regions or the plurality of materials may include, for example, density, porosity, water absorbency/repellence, strength, flexibility, elasticity, softness, durability, chemical resistance, thermal conductivity, and the like.

In some cases, the upper 104 may comprise, for example, natural leather, synthetic leather, knits, non-woven materials, natural fabrics, and/or synthetic fabrics. In other cases, the upper 104 may comprise breathable mesh and/or synthetic textile fabrics made from materials such as nylons, polyesters, polyolefins, polyurethanes, rubbers, foams, or any combinations thereof. The material of the upper 104 may be selected and/or optimized based on desired properties such as breathability, durability, flexibility, comfort, and/or water resistance.

In some embodiments, the shoe 100 may be waterproof. In some cases, at least a forefoot area 124 of the upper 104 may be constructed of one or more materials or layers (e.g., membranes) having water resistant properties. Additional features (e.g., non-porous or semi-porous membranes that permit a selective movement or passage of moisture) may be applied when fabricating the shoe 100 to provide additional waterproofing capabilities.

In some embodiments, the upper 104 may comprise an instep region with an opening 114 for inserting a subject's foot. In some cases, the instep region may include a tongue member 110.

In some embodiments, the upper 104 may comprise an insole and/or one or more insole components. The one or more insole components may include, for example, a footbed (e.g., an insole footbed) and/or a board (e.g., an insole board), as described elsewhere herein. In some non-limiting embodiments, the upper 104 may comprise a footbed 126. In some embodiments, the footbed 126 may be designed to provide support for a subject's foot (e.g., as the subject exerts a force on the insole while walking, running, kneeling, squatting, or executing a swing). The footbed may be flexible, semi-rigid, or rigid. In some cases, the footbed 126 may be a removable insert that can be positioned within the shoe 100. In some examples, the footbed 126 can be worn inside the shoe 100 and may be designed to provide cushioning or comfort for the subject wearing the shoe 100. In any of the embodiments described herein, the footbed 126 may comprise or may be referred to interchangeably as an insole, an insole component, an insole footbed, an insert, or a liner (e.g., a sock liner).

In some embodiments, the upper 104 may comprise a heel collar 118 extending around at least a portion of the opening 114. The heel collar 118 may be configured to provide enhanced comfort and fit.

In some embodiments, the forefoot region of the upper 104 may comprise an eye stay 112 that may be attached to the vamp 108. In some cases, the eye stay 112 may cover at least a portion of the tongue member 110. In some cases, the eye stay 112 may comprise one or more eyelets through which one or more laces 119 can be threaded.

In any of the embodiments described herein, a variety of tightening systems can be used for tightening the shoe 100 around the contour of the foot. For example, laces 119 of various types of materials (e.g., natural or synthetic fibers, metal cable) may be included in the tightening system. In some cases, the shoe 100 may include a metal cable (lace)-tightening assembly that may comprise a dial, spool, and housing and locking mechanism for locking the cable in place.

In some cases, the upper 104 may have a traditional shape. In other cases, the upper 104 may comprise a shape that is non-traditional.

In some embodiments, the golf shoe may comprise a sole assembly 106. The sole assembly 106 may be connected to the upper 104. The sole assembly 106 may comprise a midsole and/or an outsole.

In some embodiments, the sole assembly 106 may comprise a midsole 111. The midsole 111 may comprise a relatively lightweight material configured to provide cushioning to the shoe 100. The midsole 111 may be made from one or more midsole materials such as, for example, foamed ethylene vinyl acetate copolymer (EVA) or foamed polyurethane compositions. In one example, the midsole 111 may be constructed using a plurality of different foamed materials.

In some cases, the hardness of the midsole material may affect the stiffness of the midsole. In one example, for a midsole comprising a relatively soft material, the midsole may retain flexibility in torsion or during bending/flexing regardless of the presence or positioning of a longitudinal groove in the midsole. In another example, for a midsole comprising a relatively hard material, the presence and positioning of a longitudinal groove in the midsole may provide a more pronounced and noticeable effect on the flexural and/or torsional stiffness of the midsole or any portion thereof.

The midsoles of the present disclosure may have a hardness which can pronounce the effects that longitudinal grooves have on the flexibility or stiffness of the midsole. In some cases, the midsoles may have a shore C hardness ranging from about 65 to about 70. In some cases, the midsoles may have a shore C hardness ranging from about 55 to about 60. In some cases, the midsoles may have a shore C hardness ranging from about 75 to about 85. In some cases, the midsoles may have a shore C hardness ranging from about 50 to about 90.

In some embodiments, the sole assembly 106 may comprise an outsole 116. The outsole 116 may be designed to provide support and traction for the shoe. In some embodiments, the outsole 116 may be integrated with the midsole 111. For example, the midsole 111 may be fused with the outsole 116 or otherwise attached to outsole 116 (e.g., using an adhesive or as part of a manufacturing process for the midsole and/or the outsole). In some cases, the midsole 111 can be molded as a separate piece and then joined to a top surface of the outsole 116 by stitching, adhesives, or other suitable means. For example, the midsole 111 can be heat-pressed and bonded to the top surface of the outsole 116. In some examples, the midsole 111 and the outsole 116 can be molded using a 'two-shot' molding method. In any of the embodiments described herein, the midsole 111 may be positioned above the outsole 116 such that at least a portion of the midsole 111 is between a subject's foot and the outsole 116.

In some embodiments, a bottom surface of the outsole 116 may include a plurality of traction members to help provide traction between the shoe 100 and the different surfaces of a golf course or other ground surfaces (G). The traction members may comprise any suitable material such as, for example, rubbers, plastics, and combinations thereof. Thermoplastics such as nylons, polyesters, polyolefins, and polyurethanes can also be used in combination or interchangeably. In some embodiments, the traction members may comprise thermoplastic polyurethane (TPU). Alternatively, different polyamide compositions including polyamide copolymers and/or aramids can be used to form the traction members. In one example, an elastomer comprising block copolymers of rigid polyamide blocks and soft polyether blocks can be used.

In some embodiments, the plurality of traction members may comprise spikes (e.g., hard spikes or soft spikes). The spikes may comprise a protrusion that is configured to at least partially penetrate or otherwise physically interface with or contact a ground surface. In some embodiments, the plurality of traction members may not or need not comprise any spikes (e.g., the outsole may be spikeless). In some cases, the traction members may comprise a grooved or textured surface or material that is configured to reduce or restrict a lateral or translational movement of the shoe relative to a ground surface when a force (e.g., the body weight of a subject or any additional forces relating to a golf-related movement) is exerted on the sole assembly of the shoe. In some cases, the grooved or textured surface may have a higher coefficient of friction (e.g., static and/or dynamic frictional coefficient) than other portions of the outsole. In some embodiments, at least one of the plurality of traction members may be removable or detachable from the outsole. In some embodiments, at least one of the plurality of traction members may be permanently attached or coupled to the outsole or another portion of the sole assembly. In some alternative embodiments, the outsole may not or need not comprise any traction elements.

In any of the embodiments described herein, the upper, the sole assembly, and/or any components thereof (e.g., the insole, the insole footbed, the insole board, the midsole, and/or the outsole) may comprise a forefoot region, a midfoot region, and a rearfoot region. Each of the forefoot region, the midfoot region, and the rearfoot region may correspond to a respective forefoot, midfoot, and rearfoot anatomy of a subject's foot. In general, the anatomy of a human foot can be divided into three bony regions. A rearfoot region of the foot may include the ankle (talus) and heel (calcaneus) bones. A midfoot region of the foot may include the cuboid, cuneiform, and navicular bones that form the longitudinal arch of the foot. The forefoot region of the foot may include the metatarsals and the toes. The shoe 100, and accordingly, the upper 104, midsole 111, and outsole 116, may comprise a rearfoot region corresponding to the rearfoot (which may include a heel area), a midfoot region that corresponds to the midfoot, and a forefoot region corresponding to the forefoot (which may include a toe area).

In some cases, the rearfoot region (and heel area) can correspond to a posterior end of the shoe 100. In some cases, the forefoot area, including the toe area, can correspond to an anterior end of the shoe 100.

In addition to having a rearfoot region, midfoot region, and forefoot region, the shoe 100, and accordingly, the upper 104, midsole 111, and outsole 116, may also have a medial side and a lateral side that are opposite one another. The medial side may generally correspond to an inside area of the wearer's foot and a surface that faces toward the wearer's other foot. The lateral side may generally correspond to an outside area of the wearer's foot and a surface that faces away from the wearer's other foot. The lateral side and the medial side may extend through each of the rearfoot area, the midfoot area, and the forefoot area. In some cases, the medial side and a lateral side may extend around the periphery or perimeter of the shoe 100.

In some embodiments, the golf shoe may comprise one or more grooves provided on an internal portion, surface, layer, or component of the sole assembly. In some cases, the one or more grooves may be provided on an insole, a footbed (e.g., an insole footbed), an insole board, a midsole, or an outsole of the sole assembly.

Figure 2B:
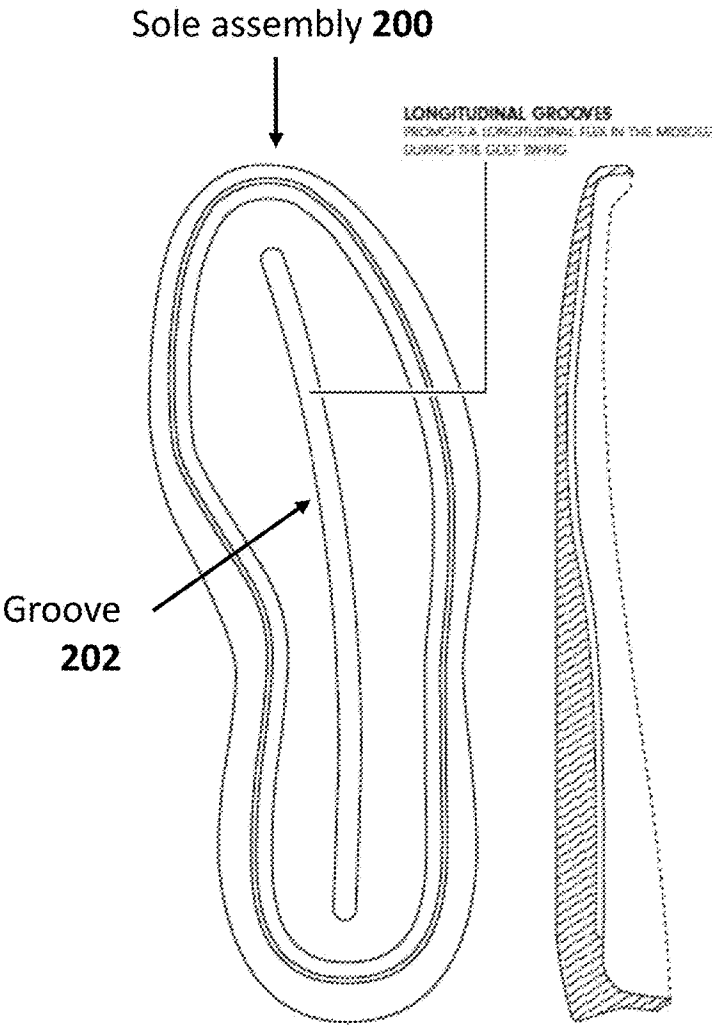
FIG. 2B depicts an example of a golf shoe comprising an internal longitudinal groove, in accordance with some embodiments.
Figure 2A:
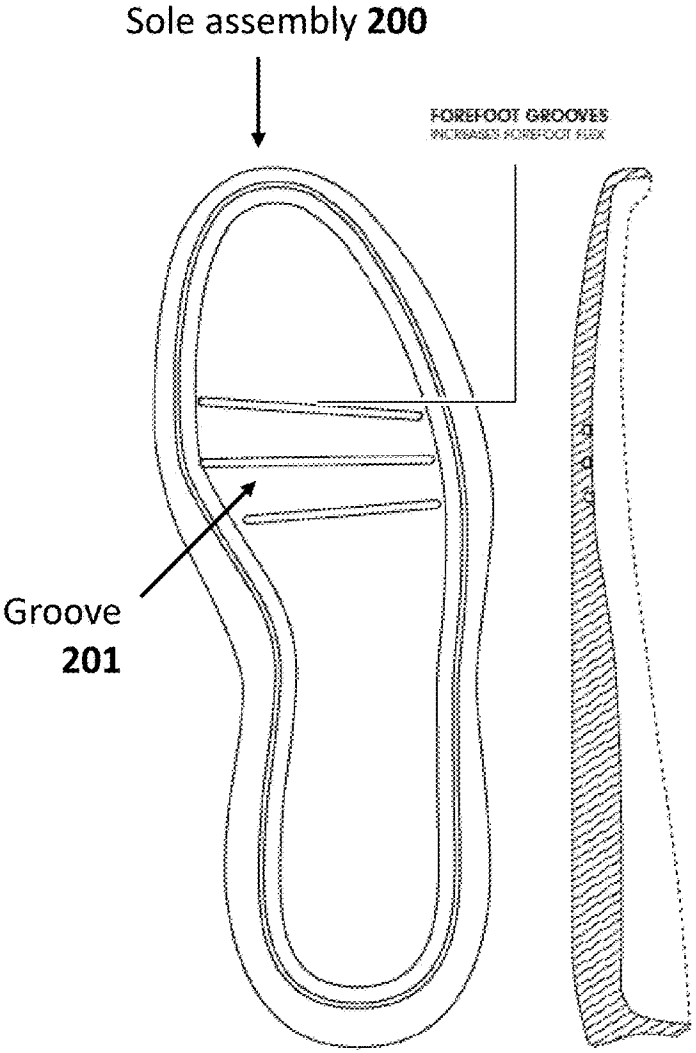
FIG. 2A (prior art)
FIG. 2A depicts an example of a golf shoe comprising one or more transverse forefoot flex grooves, in accordance with some embodiments.

FIGS. 2A and 2B schematically illustrate various examples of a sole assembly 200 comprising one or more grooves 201, 202. The sole assembly 200 may comprise a midsole 111 as described elsewhere herein. In some embodiments, for example as shown in FIG. 2A, the one or more grooves 201 may comprise one or more internal forefoot grooves disposed between a medial edge and a lateral edge of the midsole 111. The one or more internal forefoot grooves may be configured to increase forefoot flex so that the forefoot region of the shoe bends more easily relative to a midfoot or rearfoot region of the shoe. In some cases, the one or more grooves 201 may comprise at least one transverse groove. In some embodiments, for example as shown in FIG. 2B, the sole assembly 200 may comprise at least one groove 202 extending between a forefoot region and a rearfoot region of the midsole 111. The at least one groove 202 may comprise a longitudinal groove configured to increase a longitudinal flex capability of the shoe, thereby allowing a medial side of the midsole to flex more easily relative to a lateral side of the midsole.

In some embodiments, the upper of the shoe may comprise a footbed, as described elsewhere herein. In some cases, the one or more grooves 201 may comprise one or more internal forefoot grooves disposed between a medial edge and a lateral edge of the footbed. In some cases, the one or more grooves 201 may comprise one or more internal forefoot grooves disposed between a forefoot region and a rearfoot region of the footbed. In some embodiments, the one or more grooves 201 on the footbed may be configured to increase a longitudinal flex capability of the shoe, thereby allowing a medial side of the footbed to flex more easily relative to a lateral side of the footbed.

In some embodiments, the one or more grooves may comprise an indent, a depression, a thinned region, or a line of flex that is disposed on a portion of the upper and/or the sole assembly (e.g., an insole footbed, an insole board, the midsole, and/or the outsole of the shoe). In some cases, the one or more grooves may be disposed on a surface or an interior region of the insole footbed, the insole board, the midsole, and/or the outsole.

In some embodiments, the one or more grooves may be disposed on an upper surface of the insole board and/or the midsole. The upper surface of the insole board may correspond to a surface of the insole board that is in contact with and/or in close proximity to the subject's foot when the subject is wearing the golf shoe. The upper surface of the midsole may correspond to a surface of the midsole that is adjacent to a bottom surface of the insole board. In some cases, the bottom surface of the insole board may be on an opposite side of the upper surface of the insole board. In some embodiments, the insole board may be positioned between a footbed and a midsole of the shoe.

In some embodiments, the one or more grooves may be disposed on a bottom surface of the insole board and/or the midsole. The bottom surface of the insole board may comprise a surface of the insole board that is opposite the upper surface of the insole board. In some cases, the bottom surface of the insole board may be positioned proximal or adjacent to the upper surface of the midsole. The bottom surface of the midsole may comprise a surface of the midsole that is opposite the upper surface of the midsole. In some cases, the bottom surface of the midsole may be positioned proximal or adjacent to the outsole. In some cases, at least a portion of the bottom surface of the midsole may be integrated with the outsole (or a portion thereof).

In some embodiments, the one or more grooves may be disposed on an upper and/or lower surface of the footbed of the shoe. In some cases, the upper surface of the footbed may be proximal or adjacent to the subject's foot when the subject is wearing the golf shoe. In some cases, the lower surface of the footbed may be proximal or adjacent to an upper surface of the insole board.

In some embodiments, the one or more grooves may be disposed within or on a discrete layer or internal surface of the sole assembly. For example, the one or more grooves may be disposed within an interior region or surface of the insole layer and/or the midsole layer of the sole assembly. In some non-limiting embodiments, the one or more grooves may comprise a cavity or a hollowed region extending through a volume of the insole footbed, the insole board, and/or the midsole, or a bulk/base material of the insole footbed, the insole board, and/or the midsole.

In any of the embodiments described herein, the one or more grooves may not or need not be filled with a material. For example, the one or more grooves may be unfilled such that the grooves form an opening or a channel in or through an inner volume of the sole assembly. In some cases, the one or more grooves may provide a gap or a separation distance between (i) a surface on which the one or more grooves are disposed and (ii) another surface or layer of the sole assembly that is proximal to the surface on which the grooves are disposed.

In some cases, the gap or separation distance may be located at an interface between two layers of the shoe. The two layers may include, for instance, an upper, a footbed, an insole footbed, an insole board, a midsole, and/or an outsole of the shoe. In some cases, the gap or separation distance formed by the one or more grooves may be located between a bottom surface of a footbed of the shoe and an upper surface of an insole board of the sole assembly. In some cases, the gap or separation distance formed by the one or more grooves may be located between a bottom surface of the insole board and a top surface of the midsole. In some cases, the gap or separation distance formed by the one or more grooves may be located between a bottom surface of the midsole and a top surface of the outsole. In any of the presently disclosed embodiments, the opening or channel formed in or through the inner volume of the sole assembly may be configured to facilitate a bending or a flexing of a first portion of the sole assembly (e.g., a medial side of the sole assembly) relative to a second portion of the sole assembly (e.g., a lateral side of the sole assembly). Such bending or flexing may occur along an axis extending along a length or a section/segment of the opening or channel.

In some alternative embodiments, the one or more grooves may be filled or partially filled with a material. In some cases, the one or more grooves may be partially filled such that a gap or separation distance still exists between various portions or layers of the shoe. In some cases, the one or more grooves may be filled with a filler material. In some cases, the filler material may be configured to impart a set of material properties to the sole assembly that is different than the bulk material properties of the sole assembly or the individual layers of the sole assembly.

Figure 3:
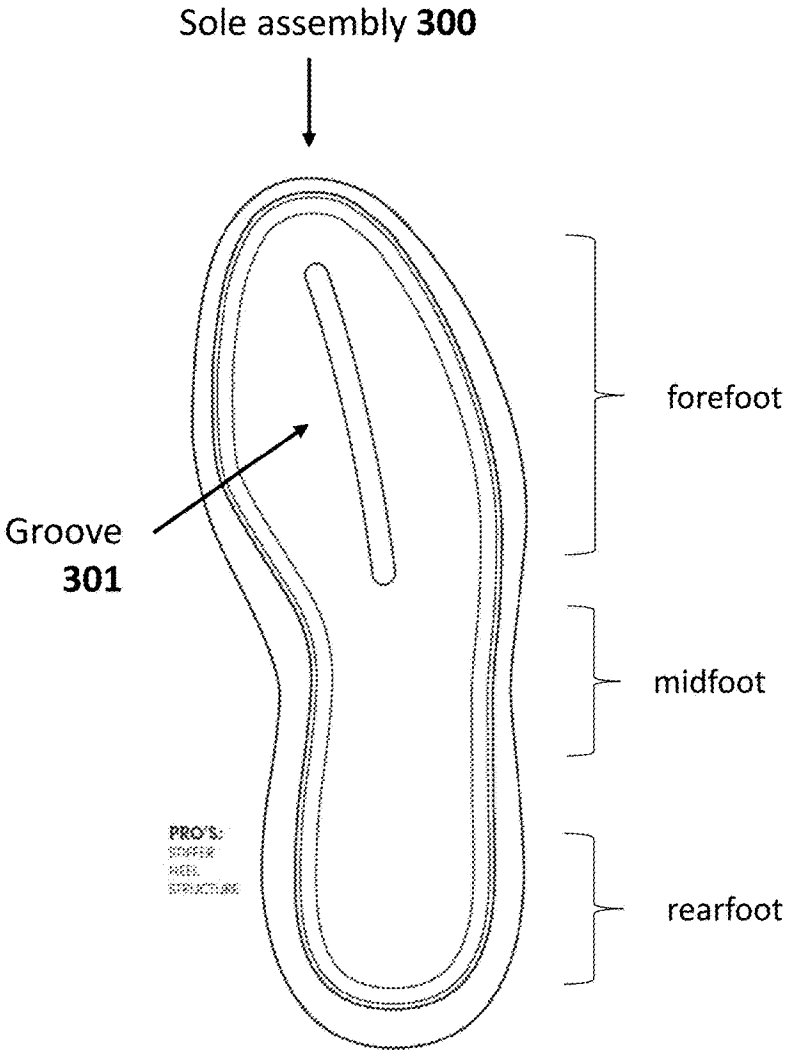
FIG. 3 depicts an example of a golf shoe with a sole assembly comprising an insole and/or a midsole with a longitudinal groove disposed in a forefoot region of the insole or midsole, in accordance with some embodiments.

In some embodiments, (e.g., as shown in FIG. 3), the upper and/or the sole assembly 300 may comprise an insole footbed, an insole board, and/or a midsole comprising a longitudinal groove 301 disposed in a forefoot region of the insole footbed, the insole board, or midsole. The longitudinal groove 301 may be positioned in the forefoot region to provide a stiffer heel structure in the rearfoot region. The rearfoot region may have a desired flexural or torsional property that is imparted based at least in part on the position and orientation of the longitudinal groove 301.

In some cases, the rearfoot region may have a flexural rigidity ranging from about 10 Newton-centimeters (N-cm) to about 100 N-cm or more. In some cases, the rearfoot region may have a flexural strength ranging from about 100 megapascals (MPa) to about 500 MPa or more. In some cases, the rearfoot region may have a flexural modulus ranging from about 5,000 MPa to about 10,000 MPa or more.

In some cases, the rearfoot region may have a torsional rigidity ranging from about 10 Newton-centimeters (N-cm) to about 100 N-cm or more. In some cases, the rearfoot region may have a torsional stiffness ranging from about 10 Newton-centimeters per degree (N-cm/deg) to about 100 N-cm/deg or more. In some cases, the rearfoot region may have a torsional shear modulus ranging from about 0.1 Megapascals (MPa) to about 100 MPa or more.

Figure 4:
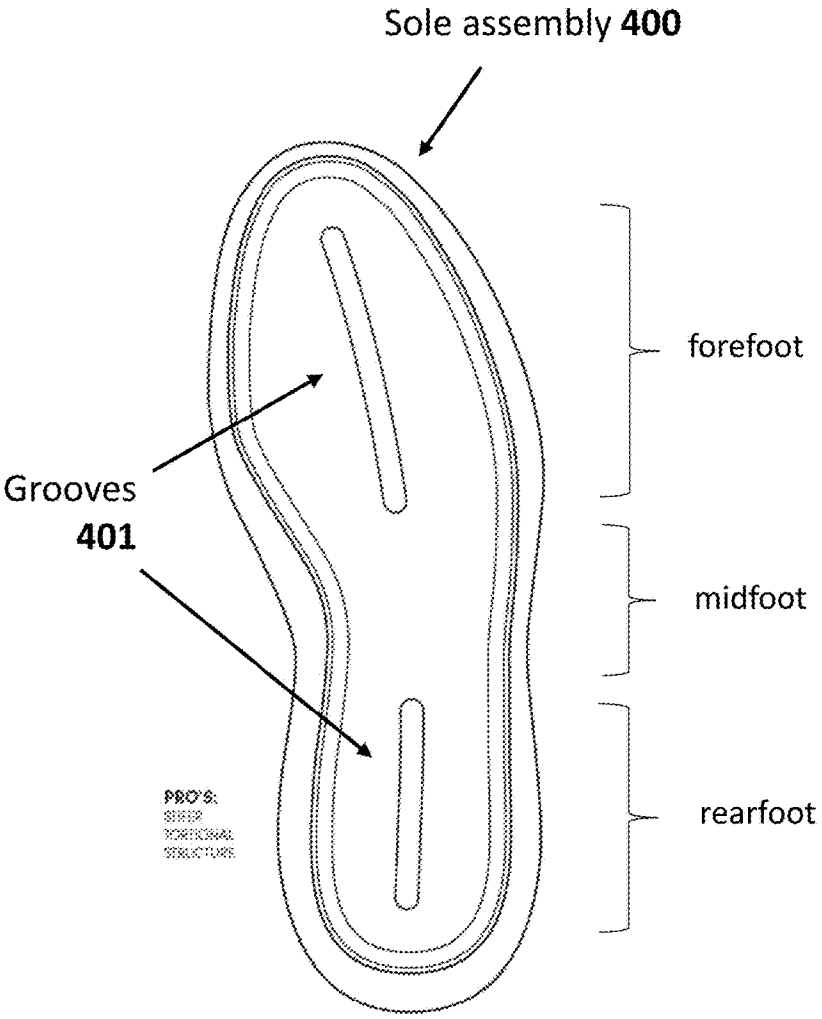
FIG. 4 depicts an example of a golf shoe with a sole assembly comprising an insole and/or a midsole with a longitudinal groove disposed in a forefoot region and a rearfoot region of the insole or midsole, in accordance with some embodiments.

In other embodiments, (e.g., as shown in FIG. 4), the upper and/or the sole assembly 400 may comprise an insole footbed, an insole board, and/or a midsole comprising a plurality of longitudinal grooves 401 disposed in a forefoot region and a rearfoot region of the insole footbed, the insole board, or midsole. The longitudinal grooves 401 may be positioned in the forefoot region and the rearfoot region to provide a stiffer flexural and/or torsional structure in at least the midfoot region of the insole footbed, the insole board, and/or the midsole, compared to a forefoot and/or a rearfoot region of the insole footbed, the insole board, and/or the midsole. The midfoot region may have a desired flexural and/or torsional property that is imparted based at least in part on the position and orientation of the longitudinal grooves 401.

In some cases, the midfoot region of the insole footbed, the insole board, and/or the midsole may have a flexural rigidity ranging from about 10 Newton-centimeters (N-cm) to about 100 N-cm or more. In some cases, the midfoot region of the insole footbed, the insole board, and/or the midsole may have a flexural strength ranging from about 100 megapascals (MPa) to about 500 MPa or more. In some cases, the midfoot region of the insole footbed, the insole board, and/or the midsole may have a flexural modulus ranging from about 5,000 MPa to about 10,000 MPa or more.

In some cases, the midfoot region may have a torsional rigidity ranging from about 10 Newton-centimeters (N-cm) to about 100 N-cm or more. In some cases, the midfoot region may have a torsional rigidity ranging from about 20 Newton-centimeters (N-cm) to about 80 N-cm or more. In some cases, the midfoot region may have a torsional stiffness ranging from about 10 Newton-centimeters per degree (N-cm/deg) to about 100 N-cm/deg or more. In some cases, the midfoot region may have a torsional stiffness ranging from about 20 Newton-centimeters per degree (N-cm/deg) to about 80 N-cm/deg or more. In some cases, the midfoot region may have a torsional shear modulus ranging from about 0.1 MPa to about 100 MPa or more.

In some embodiments, the one or more grooves may comprise a plurality of grooves that are disposed within different components or internal portions or regions of the upper and/or the sole assembly. In one example, the plurality of grooves may comprise a first groove disposed on a first surface region of the insole footbed, the insole board, or the midsole and a second groove disposed on a second surface region of the insole footbed, the insole board, or the midsole. In some cases, the first surface region may correspond to an upper surface of the insole footbed, the insole board, or the midsole. In some cases, the second surface region may correspond to a lower surface of the insole footbed, the insole board, or the midsole. In some cases, the first surface region and the second surface region may correspond to different subregions of an upper or lower surface of the insole footbed, the insole board, or the midsole. In another example, the plurality of grooves may comprise a first groove disposed on a surface or a portion of the insole footbed and/or the insole board, and a second groove disposed on a surface or a portion of the midsole. In some cases, the plurality of grooves may comprise a first groove disposed on a surface or a portion of the insole footbed, the insole board, or the midsole and a second groove disposed on a surface or a portion of the outsole.

In some embodiments, the plurality of grooves may be aligned relative to each other. For instance, a first longitudinal groove of the plurality of grooves may be positioned over or above a second longitudinal groove of the plurality of grooves, and the second longitudinal groove may be positioned below or under the first longitudinal groove. In some embodiments, when the first and second longitudinal grooves are aligned relative to each other, the first longitudinal groove and the second longitudinal groove may at least partially coincide if (1) the first longitudinal groove is projected onto a plane comprising the second longitudinal groove or (2) the second longitudinal groove is projected onto a plane comprising the first longitudinal groove. The plane comprising the first longitudinal groove may correspond to a portion of the insole footbed or insole board. The plane comprising the second longitudinal groove may correspond to a portion of the midsole. When aligned, the first and second longitudinal grooves may be configured to collectively enhance the ability of the insole footbed, the insole board, and/or the midsole to flex longitudinally about a reference line or axis corresponding to (i) a position or orientation of the first and/or second longitudinal groove or (ii) a direction in which the first and/or second longitudinal groove extends across the insole footbed, the insole board, and/or the midsole.

In some embodiments, the one or more grooves may comprise a cross-sectional shape. The cross-sectional shape may comprise a circular shape or a polygonal shape. In some cases, the cross-sectional shape may comprise, for example, a circle, an ellipse, or any polygon having three or more sides. The cross-sectional shape may comprise a regular shape (e.g., a shape having two or more sides with a same length) or an irregular shape (e.g., a shape having two or more sides with different lengths). In some cases, the cross-sectional shape may comprise at least one linear portion or section. In some cases, the cross-sectional shape may comprise at least one curved or non-linear portion or section. In some cases, the cross-sectional shape may comprise at least one linear portion or section and at least one curved or non-linear portion or section.

The one or more grooves may comprise a groove length. The length of the one or more grooves may be at least about 5%, 10%, 15%, 20%, 25%, 30%, 35%, 40%, 45%, 50%, or more of a total length of the insole footbed, the insole board, and/or the midsole from a most-posterior point of the insole footbed, the insole board, and/or the midsole. In some cases, the groove length may range from about 1 centimeter (cm) to about 20 cm or more. In some cases, the groove length may range from about 1 cm to about 25 cm. In some cases, the groove length may range from about 1 cm to about 30 cm.

The one or more grooves may comprise a groove width. The width of the one or more grooves may be at least about 5%, 10%, 15%, 20%, 25%, 30%, 35%, 40%, 45%, 50%, or more of a width of the insole footbed, the insole board, and/or the midsole. In some cases, the groove width may range from about 5 millimeters (mm) to about 3 cm or more.

The one or more grooves may comprise a groove depth. The depth of the one or more grooves may be at least about 5%, 10%, 15%, 20%, 25%, 30%, 35%, 40%, 45%, 50%, or more of a vertical thickness of the insole footbed, the insole board, and/or the midsole. In some cases, the groove depth may range from about 0.5 mm to about 12 mm in a forefoot region of the shoe. In some cases, the groove depth may range from about 0.5 mm to about 25 mm in a rearfoot region of the shoe.

In some embodiments, the one or more grooves may comprise a plurality of dimensions. The plurality of dimensions may comprise at least a first dimension and a second dimension. In some cases, the plurality of dimensions may comprise at least a first dimension, a second dimension, and a third dimension. The first dimension, the second dimension, and/or the third dimension may comprise a groove length, a groove width, and/or a groove depth.

In some embodiments, the plurality of dimensions may comprise a first dimension associated with a groove length and a second dimension associated with a groove width. In some cases, the ratio between the first dimension and the second dimension may range from about 1:1 to about 50:1.

In some embodiments, the plurality of dimensions may comprise a first dimension associated with a groove length and a second dimension associated with a groove depth. In some cases, the ratio between the first dimension and the second dimension may range from about 1:1 to about 50:1.

In some embodiments, the plurality of dimensions may comprise a first dimension associated with a groove width and a second dimension associated with a groove depth. In some cases, the ratio between the first dimension and the second dimension may range from about 10:1 to about 1:10.

In some embodiments, the plurality of dimensions may comprise a first dimension associated with a groove length, a second dimension associated with a groove width, and a third dimension associated with a groove depth. In some cases, the ratio between the first dimension and the second dimension may range from about 1:1 to about 50:1. In some cases, the ratio between the first dimension and the third dimension may range from about 1:1 to about 50:1. In some cases, the ratio between the second dimension and the third dimension may range from about 10:1 to about 1:10.

In some embodiments, the one or more grooves may comprise at least one longitudinal groove. The at least one longitudinal groove may comprise a groove that extends between an anterior region and a posterior region of the insole footbed, the insole board, the midsole, or the outsole. The anterior region may correspond to a forefoot region of the insole footbed, the insole board, the midsole, or the outsole, and the posterior region may correspond to a rearfoot region of the insole footbed, the insole board, the midsole, or the outsole.

In some cases, the at least one longitudinal groove may comprise a linear groove that extends between (i) the forefoot region of the insole footbed, the insole board, the midsole, or the outsole to (ii) the rearfoot region of the insole footbed, the insole board, the midsole, or the outsole. In other cases, the at least one longitudinal groove may comprise a curved groove that extends between (i) the forefoot region of the insole footbed, the insole board, the midsole, or the outsole to (ii) the rearfoot region of the insole footbed, the insole board, the midsole, or the outsole.

In some cases, the at least one longitudinal groove may comprise a single groove that extends continuously from (i) the forefoot region of the insole footbed, the insole board, the midsole, or the outsole to (ii) the rearfoot region of the insole footbed, the insole board, the midsole, or the outsole. In some cases, the at least one longitudinal groove may comprise a single groove that extends continuously from (i) the forefoot region of the insole footbed, the insole board, the midsole, or the outsole to (ii) the midfoot region of the insole footbed, the insole board, the midsole, or the outsole. In some cases, the at least one longitudinal groove may comprise a single groove that extends continuously from (i) the midfoot region of the insole footbed, the insole board, the midsole, or the outsole to (ii) the rearfoot region of the insole footbed, the insole board, the midsole, or the outsole.

In some cases, the at least one longitudinal groove may comprise a plurality of longitudinal grooves comprising a first longitudinal groove and a second longitudinal groove. In some cases, the first longitudinal groove and the second longitudinal groove may be disposed on different portions or regions of the insole footbed, the insole board, the midsole, or the outsole. In some cases, the first longitudinal groove may be provided in a forefoot region of the insole footbed, the insole board, or the midsole, and the second longitudinal groove may be provided in a rearfoot region of the insole footbed, the insole board, or the midsole. In some cases, the first longitudinal groove may be provided in a forefoot region of the insole footbed, the insole board, or the midsole, and the second longitudinal groove may be provided in a midfoot region of the insole footbed, the insole board, or the midsole. In some cases, the first longitudinal groove may be provided in a midfoot region of the insole footbed, the insole board, or the midsole, and the second longitudinal groove may be provided in a rearfoot region of the insole footbed, the insole board, or the midsole.

In some embodiments, at least one of the insole footbed, the insole board, or the midsole may comprise one or more longitudinal grooves provided in a respective forefoot region and a rearfoot region of the insole footbed, the insole board, or the midsole to enhance a material property of at least a midfoot region of the insole footbed, the insole board, the midsole, or the sole assembly. The material property may include, for example, a flexural or a torsional stiffness of the midfoot region of the insole footbed, the insole board, the midsole, or the sole assembly.

In some cases, the positioning of the longitudinal grooves at the forefoot and rearfoot regions of the insole footbed, the insole board, and/or the midsole may provide greater flexural and/or torsional stiffness in the midfoot region of the sole assembly compared to the forefoot and/or rearfoot regions. For instance, the longitudinal grooves may be positioned and oriented on the forefoot and rearfoot regions of the insole footbed, the insole board, and/or the midsole to help provide the shoe (e.g., at least a midfoot region of the insole footbed, the insole board, or the outsole) with additional mechanical strength and structural integrity that does not allow excessive twisting or turning of the shoe. Thus, the shoe (in particular the midfoot region of the shoe) may exhibit improved torsional stability during a golf swing. At the same time, the shoe may retain longitudinal flexibility in at least the forefoot and rearfoot regions so that a subject is able to keep at least a portion of his or her feet or toes (e.g., the first and/or second metatarsal regions of the subject's foot) in contact with the ground for a longer period of time while executing a swing. In some cases, the increased contact time may allow the subject to control the movement of his or her foot more consistently as the subject shifts his or her weight during the course of the swing, leading to more powerful and accurate shots and tighter ball dispersions down range.

In some cases, at least one of the insole footbed, the insole board, or the midsole comprises one or more longitudinal grooves provided in a respective forefoot region and a rearfoot region of the insole footbed, the insole board, or the midsole to stiffen at least a midfoot region of the insole footbed, the insole board, the midsole, or the sole assembly. In some cases, the stiffness of the midfoot region may correspond to a flexural stiffness of the midfoot region. In some cases, the stiffness of the midfoot region may correspond to a torsional stiffness of the midfoot region. The flexural stiffness and the torsional stiffness of the midfoot region may be characterized using any of the metrics described elsewhere herein (including, but not limited to, material rigidity, strength, stiffness, flex, modulus, damping ratio, and the like).

In some embodiments, the one or more longitudinal grooves may comprise (1) a first longitudinal groove disposed on the forefoot region of the insole footbed, the insole board, or the midsole and (2) a second longitudinal groove disposed on the rearfoot region of the insole footbed, the insole board, or the midsole. The first longitudinal groove and the second longitudinal groove can be unconnected and/or discontinuous, and need not intersect, overlap, or coincide with each other in order to provide or enhance the longitudinal flex characteristics of the sole assembly. In some embodiments, the first longitudinal groove and the second longitudinal groove can be separated by a predetermined distance. The predetermined distance can span at least a portion of the midfoot region of the insole footbed, the insole board, or the midsole. In some cases, the predetermined distance may span at least about 5%, 10%, 15%, 20%, 25%, 30%, 35%, 40%, 45%, 50%, or more of a length of the insole footbed, the insole board, or the midsole. In some cases, the predetermined distance may be at least about 1 centimeter (cm), 2 cm, 3 cm, 4 cm, 5 cm, 6 cm, 7 cm, 8 cm, 9 cm, 10 cm, 11 cm, 12 cm, 13 cm, 14 cm, 15 cm, 16 cm, 17 cm, 18 cm, 19 cm, 20 cm, or more. In any of the embodiments described herein, the first longitudinal groove and the second longitudinal groove may be configured to collectively and synergistically enhance a longitudinal flex of the sole assembly.

In some alternate embodiments, the golf shoe may comprise (1) a first longitudinal groove disposed on the insole footbed or the insole board and (2) a second longitudinal groove disposed on the midsole. In some cases, the first longitudinal groove and the second longitudinal groove may be aligned relative to each other to collectively and synergistically enhance a longitudinal flex of the sole assembly. When aligned, the first longitudinal groove may be positioned over or above the second longitudinal groove, and the second longitudinal groove may be positioned below or under the first longitudinal groove.

In some cases, the first longitudinal groove disposed on the insole footbed or insole board may have a first geometry and the second longitudinal groove disposed on the midsole may have a second geometry. The first geometry and the second geometry may be different. In some cases, the first longitudinal groove and the second longitudinal groove may have a different size or shape. In some cases, the first longitudinal groove and the second longitudinal groove may have a different width, length, depth, or curvature.

In some embodiments, the golf shoe may further comprise an outsole comprising a third longitudinal groove. The third longitudinal groove may be positioned on an outside portion or surface of the outsole construction. In some cases, at least one of the first or second longitudinal groove may be aligned with the third longitudinal groove to collectively and synergistically enhance a longitudinal flex of the sole assembly.

In any of the embodiments described herein, the golf shoe may comprise one or more longitudinal grooves. The one or more longitudinal grooves may be positioned or located on (1) an insole board of a shoe construction (which insole board may or may not be lasted with the upper), (2) an inside of the midsole geometry (e.g., a top surface of the midsole facing in the insole board), or (3) an outside of a midsole outsole construction (e.g., within the outsole facing the ground). In some embodiments, the one or more longitudinal grooves may comprise a plurality of grooves provided in a combination of different locations (e.g., locations (1) and (2), locations (1) and (3), or locations (2) and (3)). In some embodiments, the one or more longitudinal grooves may comprise a plurality of grooves provided in each of (1), (2), and (3). In some instances, a combination of multiple grooves in different components of the shoe or sole assembly can be utilized to further enhance a longitudinal flex characteristic of the golf shoe.

In any of the embodiments described herein, one or more internal longitudinal grooves may be sized, positioned, and oriented on the insole footbed, the insole board, and/or the midsole to promote longitudinal flex characteristics while preserving the stiffness of various sections of the insole footbed, the insole board, and/or the midsole (including, for example, the midfoot regions of the insole footbed, the insole board, and/or midsole). In some cases, the one or more internal longitudinal grooves may be sized, positioned, and oriented to provide a desired stiffness, based at least in part on a player's swing type or a characteristic or property of the player's swing. The characteristic or property of the player's swing may include, for example, swing speed. In some cases (e.g., for players with a faster swing speed), the one or more internal longitudinal grooves may be sized, positioned, and oriented on the insole footbed, the insole board, and/or the midsole to retain or enhance a stiffness of the midsole. In other cases (e.g., for players with a slower swing speed), the one or more internal longitudinal grooves may be sized, positioned, and oriented on the insole footbed, the insole board, and/or the midsole to reduce the stiffness of the midsole.

In some embodiments, the one or more longitudinal grooves can be positioned and oriented to divide or partition the insole footbed, the insole board, or the midsole into a plurality of regions having different material properties. In some cases, the one or more longitudinal grooves may divide or partition the insole footbed, the insole board, or the midsole into at least a first region and a second region. The first region may correspond to a forefoot region or a midfoot region of the insole footbed, the insole board, or the midsole. The second region may correspond to a midfoot region or a rearfoot region of the insole footbed, the insole board, or the midsole. In some cases, the one or more longitudinal grooves may divide or partition the insole footbed, the insole board, or the midsole into at least a first region, a second region, and a third region. The first region may correspond to a forefoot region of the insole footbed, the insole board, or the midsole. The second region may correspond to a midfoot region of the insole footbed, the insole board, or the midsole. The third region may correspond to a rearfoot region of the insole footbed, the insole board, or the midsole. In some cases, the one or more longitudinal grooves may comprise at least one longitudinal groove positioned in the first, second, or third region or the insole footbed, the insole board, or the midsole. In some cases, the second region of the insole footbed, the insole board, or the midsole (e.g., the portion of the insole footbed, the insole board, or the midsole that corresponds to a midfoot region) may not or need not comprise any grooves, in order to provide a sole assembly having a midfoot region with a stiffer flexural and/or torsional structure than that of the forefoot or rearfoot regions.

In some non-limiting embodiments, the sole assembly may comprise a first material property for the forefoot region of the insole footbed, the insole board, or the midsole. In some non-limiting embodiments, the sole assembly may comprise a second material property for the rearfoot region of the insole footbed, the insole board, or the midsole. In some non-limiting embodiments, the sole assembly may comprise a third material property for the midfoot region of the insole footbed, the insole board, or the midsole.

In some embodiments, the first, second, and third material properties may correspond to a flexural rigidity. As used herein, flexural rigidity may refer to a force couple required to bend a structure by a unit of curvature. In some cases, the flexural rigidity of the midfoot region may be greater than the flexural rigidity of the forefoot region and/or the flexural rigidity of the rearfoot region. In some cases, the flexural rigidity of the midfoot region may be greater than the flexural rigidity of the forefoot region and/or the flexural rigidity of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have a flexural rigidity ranging from about 10 Newton-centimeters (N-cm) to about 100 N-cm or more.

In some embodiments, the first, second, and third material properties may comprise a flexural strength. As used herein, flexural strength may refer to the stress in a material at its moment of yield. In some cases, the flexural strength of the midfoot region may be greater than the flexural strength of the forefoot region and/or the flexural strength of the rearfoot region. In some cases, the flexural strength of the midfoot region may be greater than the flexural strength of the forefoot region and/or the flexural strength of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have a flexural strength ranging from about 100 megapascals (MPa) to about 500 MPa or more.

In some embodiments, the first, second, and third material properties may comprise a flexural modulus. As used herein, flexural modulus may refer to the ratio of stress to strain in flexural deformation, or the tendency for a material to resist bending. In some cases, flexural modulus can be determined from the slope of a stress-strain curve produced by a flexural test. In some cases, the flexural modulus of the midfoot region may be greater than the flexural modulus of the forefoot region and/or the flexural modulus of the rearfoot region. In some cases, the flexural modulus of the midfoot region may be greater than the flexural modulus of the forefoot region and/or the flexural modulus of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have a flexural modulus ranging from about 5,000 MPa to about 10,000 MPa or more.

In some embodiments, the first, second, and third material properties may correspond to a torsional rigidity. As used herein, torsional rigidity may refer to the resistance offered by a material to angular deformation. Torsional rigidity may be represented as the torque required to produce a unit radian angle of twist per unit length of the material undergoing or experience torsion. In some cases, the torsional rigidity of the midfoot region may be greater than the torsional rigidity of the forefoot region and/or the torsional rigidity of the rearfoot region. In some cases, the torsional rigidity of the midfoot region may be greater than the torsional rigidity of the forefoot region and/or the torsional rigidity of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have a torsional rigidity ranging from about 10 Newton-centimeters (N-cm) to about 100 N-cm or more.

In some embodiments, the first, second, and third material properties may correspond to a torsional stiffness. As used herein, torsional stiffness may refer to the amount of torque required to twist an object by a unit degree or radian. The torsional stiffness may be represented as a ratio of torque to the angular twist experience by a material. In some cases, the torsional stiffness of the midfoot region may be greater than the torsional stiffness of the forefoot region and/or the torsional stiffness of the rearfoot region. In some cases, the torsional stiffness of the midfoot region may be greater than the torsional stiffness of the forefoot region and/or the torsional stiffness of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have a torsional stiffness ranging from about 10 Newton-centimeters per degree (N-cm/deg) to about 100 N-cm/deg or more.

In some embodiments, the first, second, and third material properties may correspond to a torsional shear modulus. As used herein, torsional shear modulus may refer to a stiffness of a material to resist deformation occurring due to the application of shear stresses. Torsional shear modulus may be represented as a ratio of shear stress to the shear strain. In some cases, the torsional shear modulus of the midfoot region may be greater than the torsional shear modulus of the forefoot region and/or the torsional shear modulus of the rearfoot region. In some cases, the torsional shear modulus of the midfoot region may be greater than the torsional shear modulus of the forefoot region and/or the torsional shear modulus of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have a torsional shear modulus ranging from about 0.1 MPa to about 100 MPa or more.

In some embodiments, the first, second, and third material properties may correspond to an inverting torsional stiffness. As used herein, inverting torsional stiffness may refer to the torsional stiffness of a material experiencing or undergoing an inverting motion (e.g., the tilting of the sole of the foot inwards towards the midline of the body during a golf-related movement). In some cases, the inverting torsional stiffness of the midfoot region may be greater than the inverting torsional stiffness of the forefoot region and/or the inverting torsional stiffness of the rearfoot region. In some cases, the inverting torsional stiffness of the midfoot region may be greater than the inverting torsional stiffness of the forefoot region and/or the inverting torsional stiffness of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have an inverting torsional stiffness ranging from about 10 Newton-centimeters per degree (N-cm/deg) to about 100 N-cm/deg or more.

In some embodiments, the first, second, and third material properties may correspond to an everting torsional stiffness. As used herein, everting torsional stiffness may refer to the torsional stiffness of a material experiencing or undergoing an everting motion (e.g., the tilting of the sole of the foot outwards, away from the midline of the body during a golf-related movement). In some cases, the everting torsional stiffness of the midfoot region may be greater than the everting torsional stiffness of the forefoot region and/or the everting torsional stiffness of the rearfoot region. In some cases, the everting torsional stiffness of the midfoot region may be greater than the everting torsional stiffness of the forefoot region and/or the everting torsional stiffness of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have an everting torsional stiffness ranging from about 10 Newton-centimeters per degree (N-cm/deg) to about 100 N-cm/deg or more.

In some embodiments, the first, second, and third material properties may correspond to an inverted damping ratio. As used herein, an inverted damping ratio may refer to a damping ratio associated with a material experiencing or undergoing an inverting motion (e.g., the tilting of the sole of the foot inwards towards the midline of the body during a golf-related movement). In some cases, the inverted damping ratio of the midfoot region may be greater than the inverted damping ratio of the forefoot region and/or the inverted damping ratio of the rearfoot region. In some cases, the inverted damping ratio of the midfoot region may be greater than the inverted damping ratio of the forefoot region and/or the inverted damping ratio of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have an inverted damping ratio ranging from about 10% to about 50% or more.

In some embodiments, the first, second, and third material properties may correspond to an everted damping ratio. As used herein, an everted damping ratio may refer to a damping ratio associated with a material experiencing or undergoing an everting motion (e.g., the tilting of the sole of the foot outwards, away from the midline of the body during a golf-related movement). In some cases, the everted damping ratio of the midfoot region may be greater than the everted damping ratio of the forefoot region and/or the everted damping ratio of the rearfoot region. In some cases, the everted damping ratio of the midfoot region may be greater than the everted damping ratio of the forefoot region and/or the everted damping ratio of the rearfoot region by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, or more. In some cases, the midfoot region may have an everted damping ratio ranging from about 10% to about 50% or more.

In some embodiments, the one or more longitudinal grooves can be positioned and oriented to divide or partition the insole footbed, the insole board, or the midsole into four or more regions having different material properties. For example, in the case of a golf shoe having a first longitudinal groove disposed in a forefoot region of the insole footbed, the insole board, or the midsole and a second longitudinal groove disposed in a rearfoot region of the insole footbed, the insole board, or the midsole, the first longitudinal groove may divide the forefoot region into a first and second region, and the second longitudinal groove may divide the rearfoot region into a third and fourth region. In some cases, the first region may correspond to an area of the forefoot between (i) a medial side of the forefoot region and (ii) the first longitudinal groove. In some cases, the second region may correspond to an area of the forefoot between (i) a lateral side of the forefoot region and (ii) the first longitudinal groove. In some cases, the third region may correspond to an area of the rearfoot between (i) a medial side of the rearfoot region and (ii) the second longitudinal groove. In some cases, the fourth region may correspond to an area of the rearfoot between (i) a lateral side of the rearfoot region and (ii) the second longitudinal groove.

In some embodiments, the first longitudinal groove and the second longitudinal groove may be positioned apart from each other to provide a fifth region between the first and second longitudinal grooves. In some cases, the fifth region may correspond to the midfoot region of the insole footbed, the insole board, or the midsole. In some embodiments, the fifth region may not or need not comprise any grooves (longitudinal, traverse, or otherwise).

In some cases, the one or more longitudinal grooves may provide or impart different material properties to the forefoot, rearfoot, and midfoot regions of the insole footbed, the insole board, or the midsole. In some cases, the one or more longitudinal grooves may provide or impart different material properties to different subregions of the insole footbed, the insole board, or the midsole. The different subregions may include, for example, the first, second, third, fourth, and/or fifth regions as described and referenced above. The different material properties may include, for example, flexural or torsional stiffness, flexural or torsional rigidity, flexural or torsional strength, a damping ratio (inverted and everted), hardness, density, or compressibility.

In some embodiments, the golf shoe may further comprise one or more additional grooves. In some cases, the one or more additional grooves may comprise at least one transverse groove that extends between a lateral side and a medial side of the insole footbed, the insole board, or the midsole. In some cases, the one or more additional grooves may intersect the one or more longitudinal grooves. In other cases, the one or more additional grooves may not or need not intersect the one or more longitudinal grooves.

In some embodiments, the golf shoe may comprise one or more longitudinal grooves and one or more additional grooves. The one or more additional grooves may comprise a longitudinal groove, a transverse groove, or any other type of groove. In some embodiments, the one or more additional grooves may have a different size or shape than the one or more longitudinal grooves.

In some cases, the one or more additional grooves may have a first cross-sectional shape, and the one or more longitudinal grooves may comprise a second cross-sectional shape that is different than the first cross-sectional shape. The first and second cross-sectional shapes may be associated with a horizontal, vertical, or any other lateral cross-section of the one or more additional grooves and/or the one or more longitudinal grooves. In some cases, the first cross-sectional shape may comprise a side having a first dimension, and the second cross-sectional shape may comprise a side having a second dimension. The first dimension may be less than or equal to the second dimension. Alternatively, the first dimension may be greater than or equal to the second dimension. In some cases, the second dimension may be less than or equal to the first dimension. In other cases, the second dimension may be greater than or equal to the first dimension. In any of the embodiments described herein, the first and second dimension may correspond to a length, a width, a depth, or a curvature of the one or more additional grooves and/or the one or more longitudinal grooves.

Figure 5:
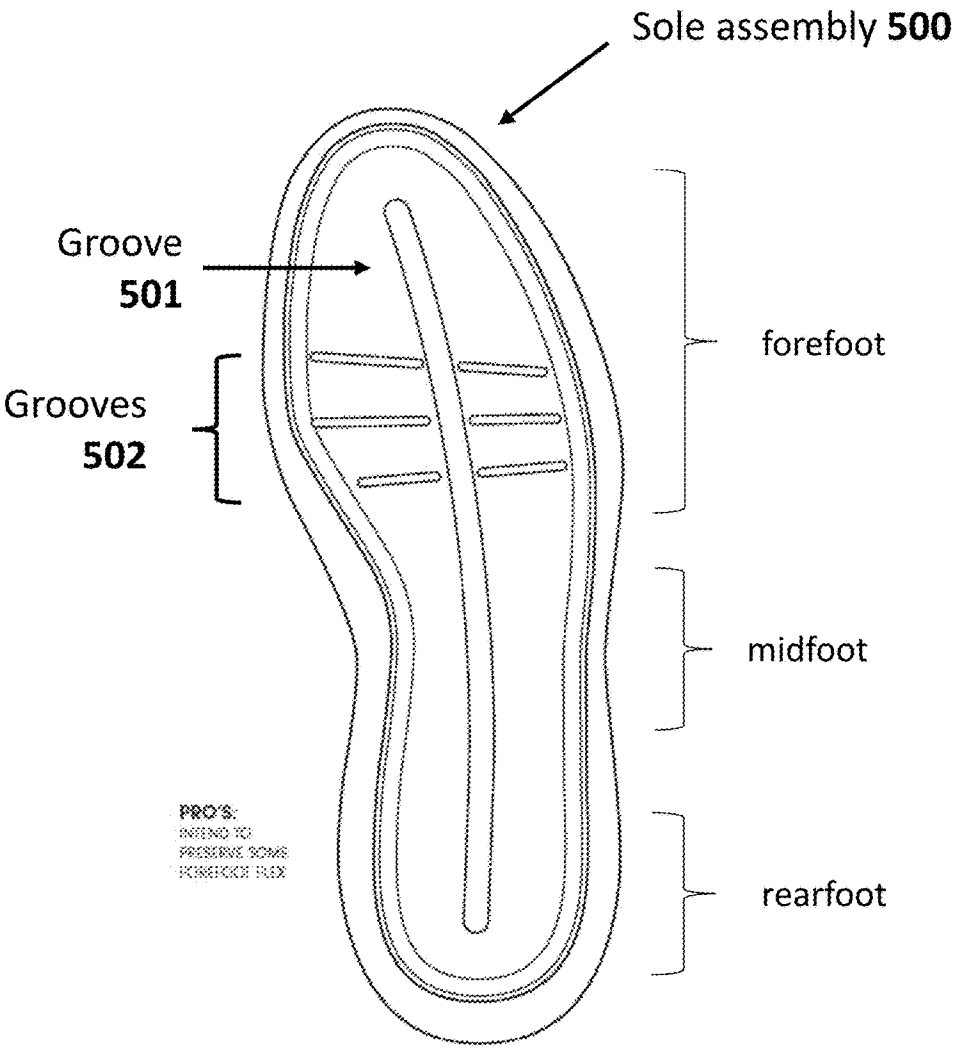
FIG. 5 depicts an example of a golf shoe with a sole assembly comprising an insole and/or a midsole with a longitudinal groove and one or more additional grooves, in accordance with some embodiments.

FIG. 5 illustrates an example of a golf shoe with an upper and a sole assembly 500. The upper and/or the sole assembly 500 may comprise an insole footbed, an insole board, and/or a midsole with a longitudinal groove 501 and one or more additional grooves 502. In some cases, the one or more additional grooves 502 may be disposed in a forefoot, midfoot, and/or rearfoot region of the insole footbed, the insole board, and/or the midsole. In some cases, the one or more additional grooves 502 may be disposed in different areas of the insole footbed, the insole board, and/or the midsole to preserve desired flex characteristics in a plurality of different regions of the insole footbed, the insole board, and/or the midsole. In some cases, the one or more additional grooves 502 may be disposed in a forefoot region of the insole footbed, the insole board, and/or the midsole to preserve forefoot flex characteristics, which can aid a golfer who may need to bend the forefoot region of the insole footbed, the insole board, and/or midsole relative to the midfoot and/or rearfoot region at some point during a game.

In some embodiments, the one or more additional grooves 502 may comprise transverse grooves that extend between a medial side and a lateral side of the insole footbed, the insole board, and/or the midsole. In some cases, the one or more additional grooves 502 may intersect with the longitudinal groove 501. In other cases, the one or more additional grooves 502 may not or need not intersect with the longitudinal groove 501.

In some embodiments, the one or more additional grooves 502 may comprise (i) a first set of additional grooves disposed between the longitudinal groove 501 and the medial side of the insole footbed, the insole board, or the midsole and (ii) a second set of additional grooves disposed between the longitudinal groove 501 and the lateral side of the insole footbed, the insole board, or the midsole. The first and second set of additional grooves may not or need not intersect. Alternatively, the first and second set of additional grooves may be configured intersect or at least partially coincide. In some cases, the first and second set of additional grooves may intersect with and/or at least partially coincide with the longitudinal groove 501. In other cases, the first and second set of additional grooves may not or need not intersect or partially coincide with the longitudinal groove 501.

Figure 6B:
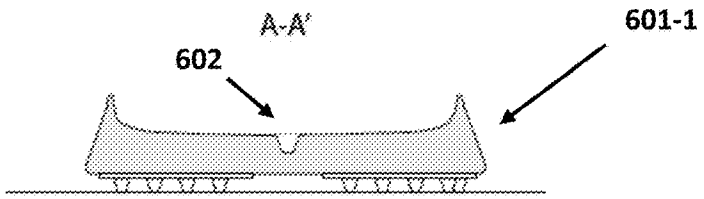
FIGS. 6B, 6C, and 6D depict various examples of vertical cross-sections for different sole assemblies for a golf shoe, in accordance with some embodiments.
Figure 6C:
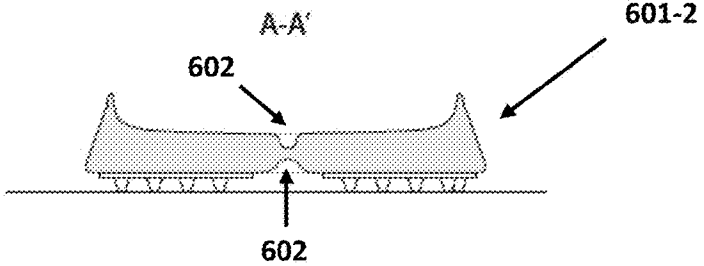
Figure 6D:
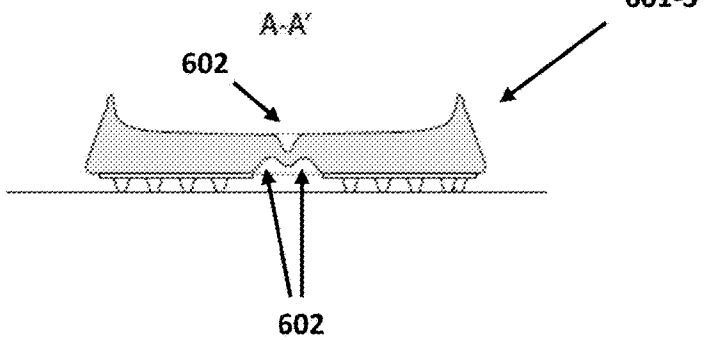
Figure 6A:
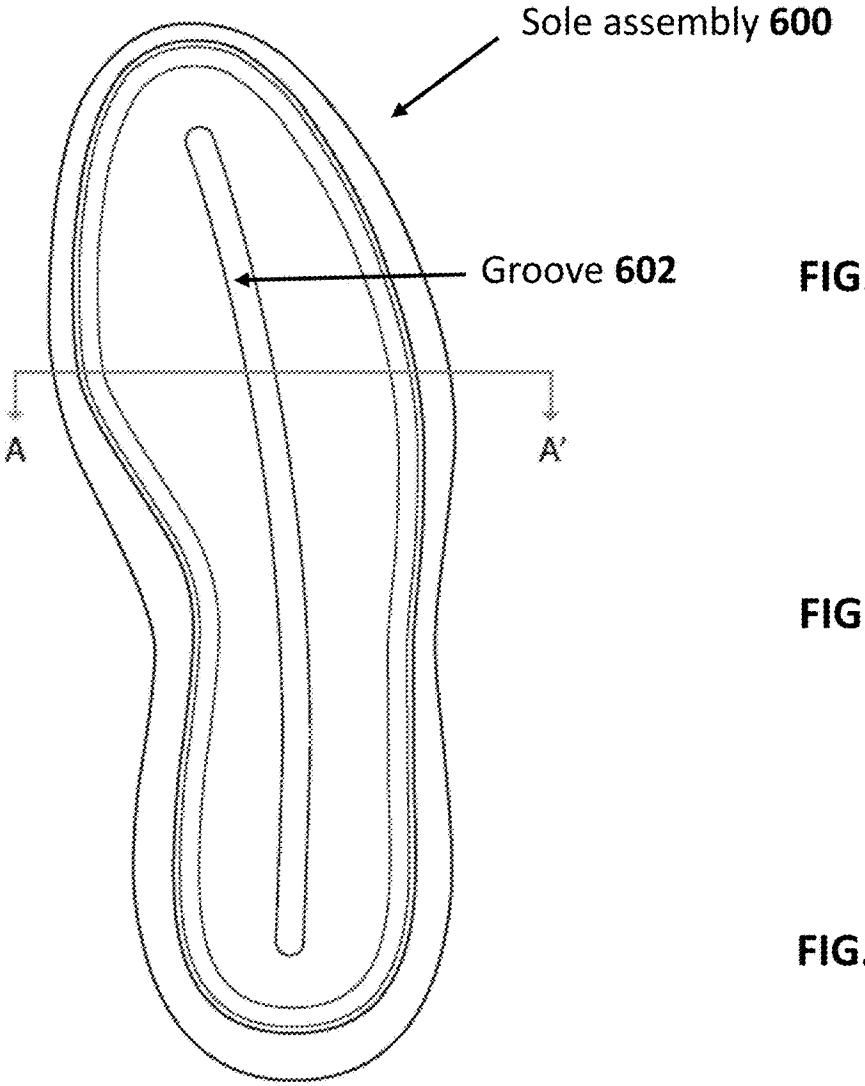
FIG. 6A depicts an exemplary sole assembly for any of the golf shoe embodiments described herein.

FIG. 6A schematically illustrates a golf shoe comprising an upper and a sole assembly 600. The upper may comprise an insole footbed and/or an insole board. The sole assembly 600 may comprise a midsole. The insole footbed, the insole board, and/or the midsole may comprise at least one internal groove 602. FIGS. 6B-6D schematically illustrate various examples of vertical cross-sections for different golf shoes

601-1, 601-2, and 601-3 comprising at least one internal longitudinal groove 602 as contemplated by the present disclosure. The golf shoes 601-1, 601-2, and 601-3 may include, for example, an insole, an insole footbed, an insole board, and/or a midsole as described elsewhere herein. The insole, the insole footbed, the insole board, and/or the midsole may comprise at least one internal longitudinal groove 602 disposed on a portion of the insole, the insole footbed, the insole board, and/or the midsole.

In some embodiments, (e.g., as shown in FIG. 6B) the golf shoe 601-1 may comprise a groove 602 disposed on an upper surface of the insole, the insole footbed, the insole board, and/or the midsole of the golf shoe. In some embodiments, (e.g., as shown in FIG. 6C) the golf shoe 601-2 may comprise a groove 602 disposed on an upper surface and a lower surface of the insole, the insole footbed, the insole board, and/or the midsole. In some embodiments, (e.g., as shown in FIG. 6D) the golf shoe 601-3 may comprise a groove 602 disposed on an upper surface of the insole, the insole footbed, the insole board, and/or the midsole and a plurality of grooves 602 disposed on a lower surface of the insole, the insole footbed, the insole board, and/or the midsole. As described elsewhere herein, the grooves may comprise an indent, a depression, a thinned region, or a line of flex that is disposed on a portion or a surface of the insole footbed, the insole board, and/or the midsole.

In any of the embodiments described herein, the at least one longitudinal groove may be configured to promote a longitudinal flex in the insole footbed, the insole board, the midsole, and/or the outsole during a golf swing. The longitudinal flex may involve a flexing or bending of a first portion of the insole footbed, the insole board, midsole, and/or outsole relative to a second portion of the insole footbed, the insole board, midsole, and/or outsole. In some cases, the longitudinal flex may involve a flexing or bending of a medial side of the insole footbed, the insole board, the midsole, and/or the outsole relative to a lateral side of the insole footbed, insole board, midsole, and/or outsole.

In some embodiments, the one or more longitudinal grooves may be configured to control (i) a movement of a subject's foot and (ii) a flex or a deformation of a lateral or medial section of the sole assembly as the subject exerts a force on the insole footbed, the insole board, or the midsole during a golf swing. The subject may be, for example, a golfer with relatively quiet feet (i.e., feet that undergo or experience minimal elevation or movement during a swing). In some cases, the placement and physical dimensions of the longitudinal grooves may be optimized for golfers with a certain swing type or a certain swing characteristic. For instance, the longitudinal groove may be sized, shaped, positioned, oriented, and/or configured to allow a medial side of the insole footbed, the insole board, or midsole to flex relative to a lateral side of the insole footbed, the insole board, or midsole, thereby allowing players with quiet feet to stay posted on their first and second metatarsal regions for a longer time period during a golf swing. The force exerted by the subject during the golf swing may comprise, for example, a compressive force and/or a rotational or torsional/shear force imparted on the insole footbed, the insole board, or the midsole as the subject shifts his or her weight and/or pivots his or her feet to execute the golf swing. In some cases, the compressive force or the shear force exerted on the insole footbed, the insole board, or the midsole may range from about 100 Newtons (N) to about 1000 Newtons or more. In some cases, the torque exerted on the insole footbed, the insole board, or the midsole by a golfer's lead foot or trail foot may range from about 5 Newton-meters (N-m) to about 500 N-m or more.

In use, the internal longitudinal grooves described herein can help golfers with quiet feet maintain a high level and degree of surface area contact with the ground in a variety of different situations, such as when making a swinging action, when stepping or otherwise moving (even on hilly or uneven terrain), and/or at other times when a golfer shifts his/her weight and/or changes his/her center of gravity while wearing the shoe. For example, when standing still on level ground (e.g., at the start of a golf swing), a subject's weight may be relatively evenly distributed over his/her feet (e.g., on the center or balls of the feet). As the subject begins a golf swing (or other swinging action), he/she may begin to shift his/her weight to the sides and/or front of the foot (e.g., toward the medial side for the front foot and toward the lateral side for the rear foot during a golf swing). As the center of gravity or weight shifts across the interior of the sole assembly, the individual sections and/or sub-sections of the sole assembly may move (e.g., flex, rotate, or translate) about the longitudinal groove such that the entire sole member does not lose contact with the ground at one time and/or at an early time in the overall swing process. As such, the flexibility of the sole assembly can help keep the medial side of the forefoot region of the trail foot on the ground for a longer time, e.g., as the subjects moves into the ball during a downswing (thereby providing solid support for the downswing and ball contact phases of a typical swing).

In some embodiments, the golf shoe may further comprise a network of grooves disposed on the insole footbed, the insole board, the midsole, or the outsole of the sole assembly. In some cases, the network of grooves may comprise different subsets of grooves configured to control (i) the flex or deformation of the lateral or medial section of the sole assembly and (ii) the movement of the subject's foot differently based on a property or characteristic of the subject's swing. The property or the characteristic may include, for example, swing speed, swing angle, swing trajectory, and/or any related biomechanical motions of a subject's body (e.g., head, shoulders, waist, hips, legs, ankle, feet, etc.) or a subject's anatomical structures (e.g., bones, joints, ligaments, tendons, etc.) to execute a golf swing. In some embodiments, the network of grooves may comprise multiple subsets of grooves configured to enhance or improve different swing types.

In some embodiments, the network of grooves may comprise a first set of grooves disposed on a first portion or section of the insole footbed, the insole board, or the midsole and a second set of grooves disposed on a second portion or section of the insole footbed, the insole board, or the midsole. In other embodiments, the network of grooves may comprise a first set of grooves disposed on the insole footbed or the insole board, and a second set of grooves disposed on the midsole. In some cases, the first set of grooves and the second set of grooves may collectively and synergistically enhance a longitudinal flex of the insole footbed, the insole board, or the midsole. In other cases, the first set of grooves and the second set of grooves may independently enhance different material properties (e.g., rigidity, stiffness, etc.) of the insole footbed, the insole board, or the midsole and/or impart different material properties to different regions of the insole footbed, the insole board, or the midsole.

In some embodiments, the network of grooves may comprise one or more longitudinal grooves and/or one or more transverse grooves. In some cases, the network of groves may comprise at least two or more grooves that intersect. In other cases, the network of groves may comprise two or more grooves that do not or need not intersect.

In another aspect, the present disclosure provides a golf shoe comprising an upper and a sole assembly connected to the upper. The upper and the sole assembly may comprise any of the features, functions, and/or materials described elsewhere herein with respect to uppers and sole assemblies.

In some embodiments, the upper and/or the sole assembly may comprise an insole footbed, an insole board, and/or a midsole. In some cases, at least one of the insole footbed, the insole board, or the midsole may comprise an internal longitudinal groove extending between a medial midfoot region and a lateral forefoot region of the insole footbed, the insole board, or the midsole to divide the insole footbed, the insole board, or the midsole into an upper sole region and a lower sole region.

Figure 7B:
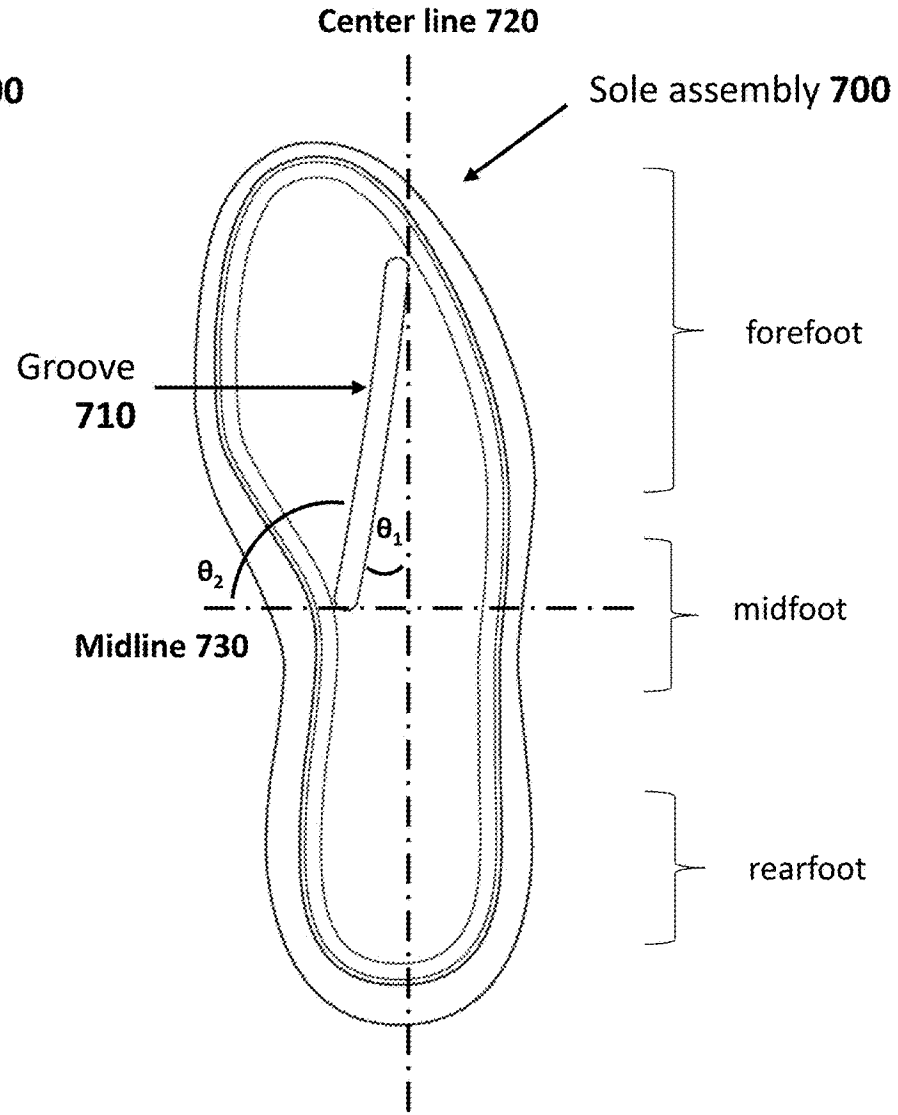
FIG. 7B depicts an internal longitudinal groove that may be disposed at an angle relative to a longitudinal center line or a midline of the sole assembly to increase a surface area of the sole assembly contacting the ground surface when the insole or the midsole flexes, in accordance with some embodiments.
Figure 7A:
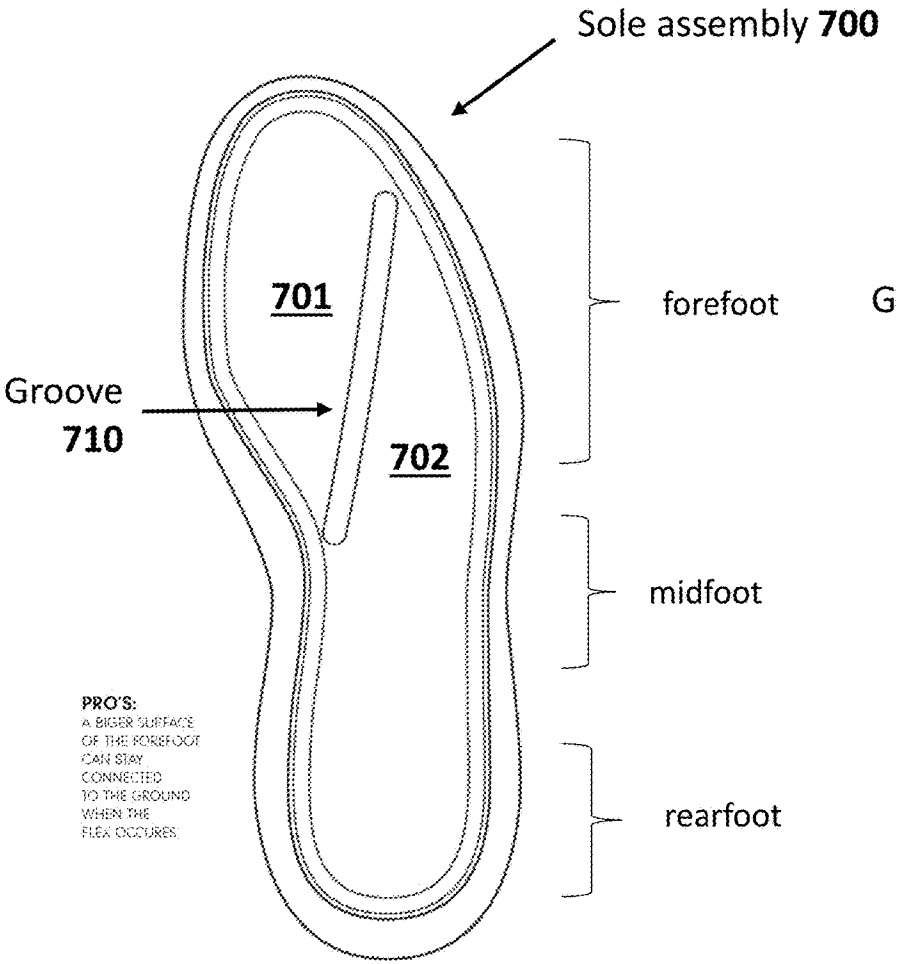
FIG. 7A depicts an example of a sole assembly comprising a groove that extends from a medial midfoot region of an insole and/or a midsole of the sole assembly to a lateral forefoot region of the insole and/or the midsole, in accordance with some embodiments.

FIG. 7A illustrates an example of a golf shoe comprising an upper and a sole assembly 700. The upper may comprise an insole footbed and/or an insole board. The sole assembly 700 may comprise a midsole. In some embodiments, the upper and/or the sole assembly 700 may comprise a groove 710 that extends from a medial midfoot region of an insole footbed, insole board, and/or a midsole of the sole assembly 700 to a lateral forefoot region of the insole footbed, the insole board, and/or the midsole. In some cases, the groove 710 may comprise a longitudinal groove that is positioned and oriented to divide the insole footbed, the insole board, or the midsole into an upper region 701 and a lower region 702. The groove 710 shown in FIG. 7A may allow a larger portion of the forefoot to stay connected to the ground when a flex occurs along the groove 710.

In some embodiments, the upper region may have a first area and the lower region may have a second area. The first area may comprise a portion of the insole footbed, the insole board, or the midsole between (i) an anterior side of the insole footbed, the insole board, or the midsole and (ii) the internal longitudinal groove extending between the medial midfoot region and the lateral forefoot region of the insole footbed, the insole board, or the midsole. The second area may comprise a portion of the insole footbed, the insole board, or the midsole between (i) a posterior side of the insole footbed, the insole board, or the midsole and (ii) the internal longitudinal groove extending between the medial midfoot region and the lateral forefoot region of the insole footbed, the insole board, or the midsole. In some embodiments, the ratio of the first area and the second area may range from about 1:1 to about 1:10. In some embodiments, the ratio of the first area and the second area may be about 25:75. In some embodiments, the ratio of the first area and the second area may be about 30:70. In some embodiments, the ratio of the first area and the second area may be about 35:65. In some embodiments, the ratio of the first area and the second area may be about 40:60. In some embodiments, the ratio of the first area and the second area may be about 45:55.

In some embodiments, the upper region and the lower region may flex independently. In some embodiments, the upper region and the lower region may flex relative to each other to increase a contact time between the sole assembly and a ground surface under the sole assembly as a subject wearing the golf shoe executes a golf swing. In some embodiments, the upper region may be configured to flex independently of the lower region to control a movement of a first and/or second metatarsal structure of the subject's foot as the subject exerts a dynamic force on the insole footbed, the insole board, or the midsole during the golf swing. The dynamic force may include, for example, a compressive force or a rotational or torsional/shear force. In some embodiments, the internal longitudinal groove may be positioned and oriented on a forefoot region of the shoe to increase (i) a surface area of the sole assembly contacting the ground surface and (ii) a contact time between the sole assembly and the ground surface when the insole footbed, the insole board, or the midsole flexes.

Referring to FIG. 7B, in some embodiments, the internal longitudinal groove 710 may be disposed at an angle $\theta_1$ relative to a longitudinal center line 720 of the insole footbed, the insole board, or the sole assembly to increase a surface area of the sole assembly contacting the ground surface when the insole footbed, the insole board, or the midsole flexes. The longitudinal center line 720 may comprise an axis extending along the center of the shoe between an anterior end of the shoe and a posterior end of the shoe. The longitudinal center line 720 may bisect the forefoot, midfoot, and/or rearfoot regions of the insole footbed, the insole board, or the sole assembly. In some cases, the angle $\theta_1$ between the internal longitudinal groove 710 and the longitudinal center line 720 may range from about 5 degrees to about 45 degrees. In some cases, the angle $\theta_1$ between the internal longitudinal groove 710 and the longitudinal center line 720 may range from about 5 degrees to about 10 degrees, about 10 degrees to about 15 degrees, about 15 degrees to about 20 degrees, about 20 degrees to about 25 degrees, about 25 degrees to about 30 degrees, about 30 degrees to about 35 degrees, about 35 degrees to about 40 degrees, or about 40 degrees to about 45 degrees. In some embodiments, the angle $\theta_1$ between the internal longitudinal groove 710 and the longitudinal center line 720 may be at least about 45 degrees or more. In some embodiments, the angle $\theta_1$ between the internal longitudinal groove 710 and the longitudinal center line 720 may be at most about 5 degrees or less.

In some embodiments, the internal longitudinal groove 710 may be disposed at an angle $\theta_2$ relative to a midline 730 of the insole footbed, the insole board, or the sole assembly to increase a surface area of the sole assembly contacting the ground surface when the insole footbed, the insole board, or the midsole flexes. The midline 730 may comprise an axis extending through a center region of the shoe between a medial side of the shoe and a lateral side of the shoe. The midline 730 may bisect the forefoot, midfoot, and/or rearfoot regions of the insole footbed, the insole board, or the sole assembly. In some cases, the angle $\theta_2$ between the internal longitudinal groove 710 and the midline 730 may range from about 90 degrees to about 135 degrees. In some cases, the angle $\theta_2$ between the internal longitudinal groove 710 and the midline 730 may range from about 90 degrees to about 95 degrees, about 95 degrees to about 100 degrees, about 100 degrees to about 105 degrees, about 105 degrees to about 110 degrees, about 110 degrees to about 115 degrees, about 115 degrees to about 120 degrees, about 120 degrees to about 125 degrees, about 125 degrees to about 130 degrees, or about 130 degrees to about 135 degrees. In some embodiments, the angle $\theta_2$ between the internal longitudinal groove 710 and the midline 730 may be at least about 135 degrees or more. In some embodiments, the angle $\theta_2$ between the internal longitudinal groove 710 and the midline 730 may be at most about 90 degrees or less.

In some embodiments, during a portion of a golf swing (e.g., the downswing, impact, and/or follow through of a golf swing), the upper region may be configured to contact the ground surface for a longer time period than the lower region when the insole footbed, the insole board, or the midsole flexes along an axis corresponding to the internal longitudinal groove. In some cases, during a portion of a golf swing (e.g., the downswing, impact, and/or follow through of a golf swing), the upper region may be configured to contact the ground surface for a first time period, and the lower region may be configured to contact the ground surface for a second time period. The first time period may be greater than the second time period by at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, or more.

In some embodiments, at least one of the insole footbed, the insole board, or the midsole may comprise an additional groove. The additional groove may comprise a longitudinal groove or a transverse groove. In some cases, the internal longitudinal groove and the additional groove may be disposed on a same region or portion of the insole footbed, the insole board, or the midsole. In other cases, the internal longitudinal groove and the additional groove may be disposed on different regions of the insole footbed, the insole board, or the midsole. In some embodiments, the additional groove may intersect or at least partially coincide with the internal longitudinal groove. In other embodiments, the additional groove may not or need not intersect or at least partially coincide with the internal longitudinal groove.

In some embodiments, at least one of the insole footbed, the insole board, or the midsole may comprise a plurality of grooves comprising the internal longitudinal groove. In some cases, the plurality of grooves may comprise (1) a first internal longitudinal groove disposed on a forefoot region of the insole footbed, the insole board, or the midsole and (2) a second internal longitudinal groove disposed on a rearfoot region of the insole footbed, the insole board, or the midsole. In other cases, the plurality of grooves may comprise (1) a first internal longitudinal groove disposed on the insole footbed or the insole board and (2) a second internal longitudinal groove disposed on the midsole. In some cases, the first internal longitudinal groove and the second internal longitudinal groove may be aligned relative to each other to collectively and synergistically enhance a longitudinal flex of the sole assembly.

Figure 8:
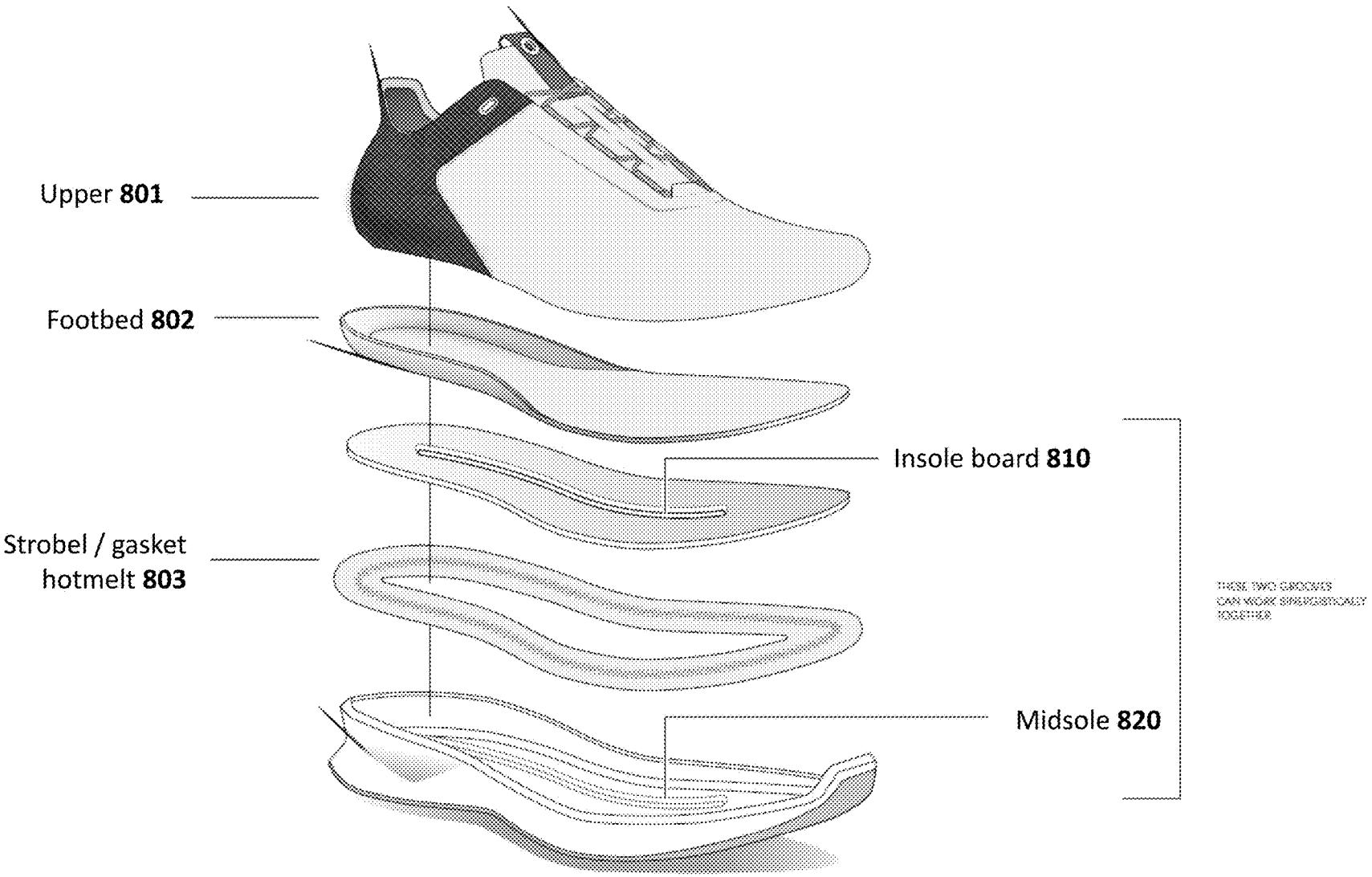
FIG. 8 depicts an exploded view of a golf shoe according to various embodiments of the present disclosure.

FIG. 8 illustrates an exploded view of a golf shoe according to various embodiments of the present disclosure. The golf shoe may comprise an upper 801 as described elsewhere herein. In some embodiments, the golf shoe may further comprise a footbed 802, an insole board 810, and a sole assembly comprising a midsole 820. In some embodiments, the footbed 802 may be positioned above the insole board 810. In some embodiments, the insole board 810 may be positioned between the footbed 802 and the midsole 820. In some embodiments, the upper 801 may be connected or fused to the midsole 820 using a cement assembly process. In some cases, a Strobel and gasket hotmelt 803 can be used to attach the insole board 810 to the upper. In such cases, the hotmelt gasket may create or provide a waterproof gasket or seal to cover the stitching used for the Strobel assembly. In other cases, the insole board 810 can be attached to the upper using a regular (toe) lasting or double (heel and toe) lasting process. In any of the embodiments described herein, the insole board 810 may comprise or may be referred to interchangeably as a board, a lasting board, a tuck board, or an insert. The board or insert may be integrated with the shoe using a lasting process or a Strobel assembly process. In some cases, the board or insert may be configured to provide support for a subject's foot. In some cases, the board or insert may comprise a layer of material that can be affixed to the upper 801 or the footbed 802 of the shoe to form an enclosed volume that is sized and shaped to accommodate a subject's foot. In some cases, the board or insert may be positioned between a footbed 802 and a midsole 820 of the shoe.

In some embodiments, the insole board 810 and the midsole 820 may each comprise an internal groove disposed on a surface of the insole board 810 and the midsole 820. In some cases, the insole board 810 may comprise a first longitudinal groove and the midsole 820 may comprise a second longitudinal groove. In some cases, the first longitudinal groove and the second longitudinal groove may be aligned relative to each other, as described elsewhere herein. The first and second longitudinal grooves may be configured to work together synergistically to enhance a longitudinal flexibility of the insole board 810 and the midsole 820. In some cases, the enhanced longitudinal flexibility of the insole board 810 and the midsole 820 may allow a medial side of the insole board 810 or the midsole 820 to flex or bend relative to a lateral side of the insole board 810 or the midsole 820.

In another aspect, the present disclosure provides a method for constructing the golf shoes of the present disclosure. In some embodiments, the method may comprise constructing an upper. In some cases, the upper may comprise an insole footbed and/or an insole board. In some cases, various parts or components may be stitched, glued, or otherwise attached together to form the upper.

In some embodiments, the method may comprise constructing a sole assembly. In some cases, the sole assembly may comprise a midsole. In any of the embodiments described herein, at least one of the insole footbed, the insole board, or the midsole may comprise one or more internal grooves as described above. In some cases, the one or more internal grooves may comprise at least one longitudinal flex groove.

In some embodiments, constructing the upper and/or the sole assembly may comprise attaching the insole footbed or the insole board to the midsole or the upper. In some embodiments, the insole board may be bonded to the top surface of the midsole. In some cases, portions of the insole, the midsole, and/or the shoe upper may be attached or otherwise fixed or coupled to each other using a lasting process (e.g., a single lasting process or a double lasting process), a Strobel construction method, and/or a gasket hotmelt.

In some embodiments, the method may comprise assembling an outsole to the midsole. In some cases, at least a portion or a section of the bottom surface of the midsole may be bonded to a top surface of the outsole (e.g., using adhesives, glues, cements, fasteners, or any other attachment mechanisms or techniques).

In some embodiments, the method may comprise attaching the sole assembly to the upper. In some cases, prior to attachment to the sole assembly, the upper may be pulled onto a last, and a lasting board may be attached to the upper with an adhesive. In some cases, the lasting board may then be attached to the sole assembly (e.g., with an adhesive, glue, or cement) to form the golf shoe.

In some alternative embodiments, the method may comprise attaching a material onto an open bottom of the upper, effectively closing off the open bottom of the upper to create a sock-like construction. In some embodiments, the method may further comprise attaching a portion of the upper (e.g., the insole footbed or the insole board) to a portion or a component of the sole assembly (e.g., the midsole and/or the outsole) to form the golf shoe.

In any of the embodiments described herein, the resulting sole assembly may have an optimal combination of structural rigidity, stability, and flexibility. For example, a shoe with a sole assembly comprising an insole footbed, an insole board, and/or a midsole with a longitudinal groove may be able to provide the golfer with structural support and a stable platform that does not collapse under loads, while preserving longitudinal flex characteristics to maximize the contact time between the sole assembly and the ground during a golf swing.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present technology.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right", "left", "center", "middle", "proximal", "distal", "anterior", "posterior", "forefoot", "midfoot", and "rearfoot", and the like are relative terms used to refer to one position of an element based on one perspective and should not be construed as limiting the scope of the technology.

All patents, publications, test procedures, and other references cited herein, including priority documents, are fully incorporated by reference to the extent such disclosure is not inconsistent with this technology and for all jurisdictions in which such incorporation is permitted. It is understood that the shoe materials, designs, constructions, and structures; shoe components; and shoe assemblies and sub-assemblies described and illustrated herein represent only some embodiments of the technology. It is appreciated by those skilled in the art that various changes and additions can be made to such products and materials without departing from the spirit and scope of this invention. It is intended that all such embodiments be covered by the appended claims.

What is claimed is:

1. A golf shoe comprising:

an upper;

a footbed provided within the upper, wherein the footbed is configured to support a subject's foot, and an insole board provided below the footbed; and a sole assembly comprising a midsole provided below the insole board to provide cushioning for the subject's foot and an outsole provided below the midsole so that the outsole is configured to directly contact a ground surface under the golf shoe, wherein the footbed and the insole board are provided above the midsole and the outsole, wherein the midsole is provided between the outsole and the footbed or the insole board, and wherein the insole board is provided between the midsole and the footbed, wherein the insole board comprises one or more longitudinal grooves provided in a forefoot region and a rearfoot region of the insole board, the one or more longitudinal grooves having a groove depth that is less than a vertical thickness of the forefoot region or the rearfoot region of the insole board, wherein the one or more longitudinal grooves are configured to extend across an upper surface of the insole board to form one or more channels facing a bottom surface of the footbed, wherein the one or more channels are configured to maintain one or more unfilled gaps between the insole board and the bottom surface of the footbed when the insole board and the footbed are joined together, wherein the one or more unfilled gaps are configured to enhance a longitudinal flexibility of the sole assembly for golf-related actions or movements, wherein the one or more longitudinal grooves comprise a first longitudinal groove extending along the forefoot region of the insole board and a second longitudinal groove extending along the rearfoot region of the insole board, wherein the first longitudinal groove and the second longitudinal groove are separated by a midfoot region of the insole board, wherein the midfoot region of the insole board is configured to extend across an entire width of the insole board from a medial side of the insole board to a lateral side of the insole board, wherein the midfoot region of the insole board does not comprise any grooves, and wherein the midfoot region of the insole board has a greater torsional stiffness, rigidity, or strength than the forefoot and rearfoot regions of the insole board.

2. The golf shoe of claim 1, further comprising one or more additional grooves disposed on the footbed or the midsole.

3. The golf shoe of claim 2, wherein the one or more longitudinal grooves and the one or more additional grooves are aligned relative to each other to collectively and synergistically enhance a longitudinal flexibility of the golf shoe.

4. The golf shoe of claim 2, wherein the outsole comprises at least one longitudinal groove aligned with the one or more longitudinal grooves and the one or more additional grooves to collectively and synergistically enhance the longitudinal flexibility of the golf shoe.

5. The golf shoe of claim 2, wherein the one or more additional grooves have a different size or shape than the one or more longitudinal grooves.

6. The golf shoe of claim 1, further comprising at least one longitudinal groove disposed on an upper surface of the midsole.

7. The golf shoe of claim 1, further comprising at least one longitudinal groove disposed on a lower surface of the insole board or the midsole.

8. The golf shoe of claim 1, wherein the upper surface of the insole board comprises a first groove and a lower surface of the insole board comprises a second groove positioned below or under the first groove.

9. The golf shoe of claim 1, wherein the footbed comprises one or more additional grooves formed along the bottom surface of the footbed.

10. The golf shoe of claim 9, wherein the one or more longitudinal grooves and the one or more additional grooves are aligned with each other.

11. The golf shoe of claim 9, wherein the one or more longitudinal grooves and the one or more additional grooves are configured to extend along different portions or regions of the golf shoe to provide the different portions or regions of the golf shoe with different flex characteristics.

12. The golf shoe of claim 1, wherein the footbed is entirely separated from the midsole.

13. The golf shoe of claim 1, wherein the first longitudinal groove and the second longitudinal groove have different depths.

14. The golf shoe of claim 1, wherein the insole board comprises one or more thinned regions formed by the one or more channels.

15. The golf shoe of claim 1, wherein the one or more channels comprise a bottom surface that is disposed above a lower surface of the insole board.

16. The golf shoe of claim 1, wherein each and every one of the one or more unfilled gaps spans a vertical distance that is less than the vertical thickness of the insole board.

17. The golf shoe of claim 1, wherein the midfoot region of the insole board is configured to resist flexural and torsional deformation.

* * * * *